US012780530B2

(12) United States Patent
Nasr et al.

(10) Patent No.: US 12,780,530 B2
(45) Date of Patent: Nov. 3, 2026

(54) METERED DOSAGE APPARATUS

(71) Applicant: The Salford Valve Company Limited, Escrick (GB)

(72) Inventors: Ghasem Nasr, Escrick (GB); Peter Shaw, Escrick (GB)

(73) Assignee: The Salford Valve Company Limited, Escrick (GB)

( * ) Notice: Subject to any disclaimer, the term of this patent is extended or adjusted under 35 U.S.C. 154(b) by 0 days.

(21) Appl. No.: 19/102,248

(22) PCT Filed: Aug. 9, 2023

(86) PCT No.: PCT/GB2023/052098
§ 371 (c)(1),
(2) Date: Feb. 7, 2025

(87) PCT Pub. No.: WO2024/033636
PCT Pub. Date: Feb. 15, 2024

(65) Prior Publication Data

US 2026/0008607 A1 Jan. 8, 2026

(30) Foreign Application Priority Data

Aug. 9, 2022 (GB) ..... 2211609

(51) Int. Cl.
*B65D 83/52* (2025.01)

(52) U.S. Cl.
CPC ..... *B65D 83/52* (2013.01)

(58) Field of Classification Search
CPC ..... B65D 83/52; B65D 83/48; B65D 83/425
See application file for complete search history.

(56) References Cited

U.S. PATENT DOCUMENTS 3,018,928 A * 1/1962 Meshberg ..... B65D 83/425 239/350
3,169,677 A * 2/1965 Focht ..... B65D 83/48 239/350

(Continued)

FOREIGN PATENT DOCUMENTS

| | | |
|---|---|---|
| FR | 2285815 A1 | 4/1976 |
| GB | 2474360 A | 4/2011 |
| GB | 2526821 A | 12/2015 |

OTHER PUBLICATIONS

Combined Search and Examination Report under Sections 17 and 18(3), issued by the United Kingdom Intellectual Property Office in corresponding United Kingdom Patent Application No. GB2211609.9, dated Jan. 30, 2023.

(Continued)

*Primary Examiner* — Donnell A Long
(74) *Attorney, Agent, or Firm* — ArentFox Schiff LLP

(57) ABSTRACT

A discharge assembly for discharging a metered volume of a liquid held in a pressurised or pressurisable container with a housing having a liquid inlet at a first end thereof, a valve stem having a body locating within said housing and having a head portion projecting from the second end of said housing, said valve stem being axially moveable relative to the housing between a first limit position closed to liquid discharge, and a second limit position for discharge of the metered volume, a chamber provided within the body of the valve stem and having a liquid inlet towards a first end of the chamber and a first fluid transfer passageway providing communication between the chamber and the exterior of the valve stem, and a liquid discharge element moveable from a liquid primed position to a liquid discharged position to effect discharge of the metered volume of liquid.

25 Claims, 12 Drawing Sheets

(56) References Cited

U.S. PATENT DOCUMENTS

| | | | | |
|---|---|---|---|---|
| 3,176,889 | A | 4/1965 | Potapenko et al. | |
| 3,394,851 | A * | 7/1968 | Gorman | B65D 83/425 222/402.2 |
| 6,032,836 | A * | 3/2000 | Hiscocks | B65D 83/52 222/402.2 |
| 7,040,513 | B2 * | 5/2006 | Pardonge | B65D 83/52 222/402.1 |
| 8,820,589 | B2 | 9/2014 | Ghavami-Nasr et al. | |
| 9,296,549 | B2 | 3/2016 | Ghavami-Nasr et al. | |
| 10,071,849 | B2 | 9/2018 | Nasr et al. | |
| 12,157,831 | B1 * | 12/2024 | Springer | C09D 133/04 |

OTHER PUBLICATIONS

Intention to Grand under Section 18(4), issued by the United Kingdom Intellectual Property Office in corresponding United Kingdom Patent Application No. GB2211609.9, dated Sep. 12, 2024.

International Search Report and Written Opinion, issued by the International Searching Authority in corresponding International Patent Application No. PCT/GB2023/052098, dated Nov. 23, 2023.

* cited by examiner

METERED DOSAGE APPARATUS

CROSS-REFERENCE TO RELATED APPLICATIONS

This application is a National Stage Entry of International Application No. PCT/GB2023/052098, filed Aug. 9, 2023, which claims priority to United Kingdom Patent Application No. 2211609.9, filed Aug. 9, 2022. The disclosures of the priority applications are hereby incorporated in their entirety by reference.

FIELD OF INVENTION

The present invention relates to a liquid dispensing apparatus for discharging a metered volume of a liquid. The invention relates more particularly (but not necessarily exclusively) to such an apparatus in the form of an aerosol dispensing apparatus.

BACKGROUND TO INVENTION

Two broad approaches exist to the self-propelled delivery of liquid from within an aerosol, being: (i) propulsion by means of a gas dissolved under pressure into solution with the liquid, and; (ii) the provision of substantially insoluble compressed gas within the aerosol container. Aerosol apparatus using a dissolved gas propellant (e.g. liquid natural gas, such as butane) rely upon flash-vaporisation of the dissolved gas out of the solution as a result of the pressure drop that occurs upon dispersal from the pressurised aerosol container into the atmosphere. Alternatively propulsion may be provided by an insoluble compressed gas (e.g. nitrogen, carbon dioxide or air) that is used to eject the liquid from the body of the aerosol container.

Many medical, air-freshener, insecticide and disinfectant aerosol applications require the delivery of volume metered doses from an aerosol container, and metered aerosol valves have been disclosed with respect to both methods of propulsion.

In the case of dissolved gas propellant, metered quantities of the propellant-liquid solution can be received into a metering chamber from the body of the aerosol container during a charging stage, before then being released to the atmosphere during a discharging stage, with the vaporisation of the dissolved gas (known as "flash vaporisation") driving the metered dose out of the metering chamber and into the atmosphere. The dissolved propellant used in such aerosol apparatus is typically butane, and the release of butane into the atmosphere has detrimental environmental and cost implications, as well as creating a fire safety risk. The avoidance of having to use such volatile propellants would be of significant environmental relevance.

Due to the relatively incompressible nature of the delivery liquid, a metered dose of delivery liquid will not automatically self-eject from a metering chamber. Accordingly several approaches have been used to drive the necessary ejection.

In one approach aerosol valves have been designed that bleed-off a quantity of compressed gas from the aerosol container into the metering chamber, which can then drive the accompanying liquid out of the chamber during discharge. Such a device is described in U.S. Pat. No. 3,394,851. However, such devices deplete the gas pressure within the aerosol container, thus requiring a high gas to liquid ratio with implications for manufacturing costs.

An alternative approach has used an elastomeric membrane as part of the metering chamber, which is distended during charging of a metering chamber, and which then collapses back into the chamber during the discharge stage driving the liquid contents from the metering chamber. A further related approach is known that uses a resilient bellows. Such devices are described in U.S. Pat. Nos. 4,953,759, 5,037,013 and WO9511841. Metering valves that use such resilient walls are liable to suffer from performance variations due to material variations of the resilient walls, associated implications for manufacturing yield, as well as vulnerability to reduced performance over lifetime due to deterioration of the resilient wall material.

An improved assembly for discharging a metered volume of liquid is disclosed in European Patent EP2485966, the contents of which is incorporated herein by reference. Nevertheless, the assembly disclosed in this document also has drawbacks, particularly in relation to the ease of manufacture of the valve and its suitability for use in automated discharge systems.

It would be advantageous to provide an assembly for discharging a metered volume of liquid which addresses some or all of the above-described drawbacks.

SUMMARY

According to a first aspect of the present disclosure, a discharge assembly for discharging a metered volume of a liquid held in a pressurised or pressurisable container is disclosed as set out in claim 1.

The discharge assembly may comprise:

(i) a housing having a liquid inlet at a first end thereof, (ii) a valve stem having a body locating within said housing and having a head portion projecting from the second end of said housing, said valve stem being axially moveable relative to the housing between a first limit position at which the assembly is closed to liquid discharge and a second limit position for discharge of the metered volume, (iii) a chamber provided within the body of the valve stem and having a liquid inlet towards a first end of the chamber and a first fluid transfer passageway towards the opposite, second end of the chamber, said first fluid transfer passageway providing communication between the chamber and the exterior of the valve stem, and (iv) a liquid discharge element moveable along said chamber from a liquid primed position to a liquid discharged position to effect discharge of the metered volume of liquid, wherein the exterior of the valve stem and the interior of the housing are configured such that:

(a) in the first limit position of the valve stem there is a second fluid transfer passageway along the outside of the valve stem between the inlet of the housing and said first fluid transfer passageway, and (b) in the second limit position of the valve stem a fin creates a temporary interference seal between the interior of the housing and the exterior of the valve stem so as to close said second fluid transfer passageway to fluid flow.

Such a discharge assembly provides various benefits over prior art discharge assemblies. In particular, the improved discharge assembly is more easily manufactured, provides a more reliable seal and actuation mechanism, allows for a longer stroke length, uses less material, has a lower failure rate during manufacture due to reduced deformation, and reduces the chance of a moulding pin becoming stuck during manufacture. Ultimately, these benefits combine to provide a significantly improved discharge assembly, with a far lower manufacture cycle time and improved performance.

Optionally, the fin is provided on the interior of the housing. Optionally, the fin is integral with the interior of the housing. This makes manufacture easier as described more fully below.

Optionally, the assembly comprises a seat configured to interface with the fin to provide the interference seal when the valve stem is in the second limit position. This allows for an improved seal to be provided in the second limit position, reducing the chance of failure of the discharge assembly as described more fully below.

Optionally, the seat comprises a chamfered surface. This allows for an improved seal against the fin. Optionally, the fin extends into the path of the seat by at least 0.1 mm, preferably between 0.1 mm and 0.2 mm inclusive. This ensures the fin and seat form a good seal during actuation.

Optionally, the temporary interference seal has a length of between 0.2 mm and 3 mm, preferably between 1 mm and 2 mm. This provides a robust seal with reduced chance of leakage, and allows for a longer stroke length as described more fully below.

Optionally, the housing comprises a top housing portion and a bottom housing portion. This allows for ease of manufacture and reduces stress on the lower portions and walls of the housing. In particular, the base portion of the housing is required to support fewer components. The base portion can therefore be made thinner, making manufacture quicker and more reliable as described more fully below.

Optionally, the top housing portion is configured for attachment to a mounting cup. This means the discharge assembly can be attached to any container.

Optionally, the top housing portion and the bottom housing portion are joined by a permanent interference fit. This provides a simple and robust mechanical coupling which is able to withstand the forces applied during actuation and refilling. Preferably the permanent interference fit is configured to withstand an applied force of 100N such as may occur during actuation by an automated discharge device (such as an automated air freshener) or during refilling.

Optionally, the bottom housing portion comprises a channel configured to receive the top housing portion. Optionally, the channel comprises recesses configured to receive corresponding protuberances on the top housing portion and/or the channel comprises protuberances configured to interface with corresponding recesses on the top housing portion. This provides a simple and easily mouldable mechanism for providing the permanent interference fit between the housing portions.

Optionally, the bottom housing portion comprises a base portion, said base portion having a thickness of no more than 2 mm. This facilitates fast and reliable manufacture with reduced risk of deformation, as described more fully below.

Optionally, the discharge assembly has a stroke length of at least 2 mm. This enables the discharge assembly to be utilised in a range of applications, including in an automated discharge assembly such as an automated air freshener, which typically requires a minimum stroke length of 2 mm to work reliable. This is described more fully below.

Optionally, at least one of the following volumes is tapered: one or more chambers provided within the body of the valve stem; an internal volume of the top housing portion; an internal volume of the bottom housing portion; and the first fluid transfer passageway. Tapered volumes mean that the moulding pin can be more easily removed during manufacture, as described more fully below.

Optionally, the liquid discharge element abuts a sealing surface when in the liquid discharged position, said sealing surface provided within the valve stem chamber. It will be appreciated that ensuring a good seal at this surface is very important, because a leak of fluid around the ball will lead to the discharge assembly ejecting a constant stream of fluid rather than a metered dose. The present inventors have determined a number of mechanisms for improving the seal of the liquid discharge element against the sealing surface to avoid such a scenario.

In one example, the sealing surface may comprise an O-ring or gasket, preferably made from a thermoplastic material or from rubber. An O-ring or gasket may create a superior seal against the liquid discharge element compared to a simple sealing surface that does not have such an O-ring or gasket.

Nevertheless, inserting an O-ring or gasket into the valve stem during manufacture may increase manufacture and cycle times. Accordingly, in some embodiments, the liquid sealing surface is chamfered at an angle relative to the longitudinal axis of the valve stem. This provides a more robust seal with reduced chance of failure which is easier to manufacture, as described more fully below. Such a sealing surface provides similar benefits to insertion of an O-ring or gasket, but without the added complexity during assembly. Preferably, the angle created by the chamfered sealing surface is between 120 and 180 degrees, more preferably between 120 and 160 degrees. These angles provide particularly robust seals during actuation.

Alternatively, the sealing surface may have a curved profile, preferably a convex curved profile such that the sealing surface protrudes into the valve stem interior and into the path of the liquid discharge element. Alternatively, the sealing surface may have a concave curved profile such that the sealing surface is configured to receive the liquid discharge element within the concave profile.

A sealing surface having a curved profile may provide similar benefits to a chamfered sealing surface, in particular improved sealing without the need for an O-ring or gasket to be inserted. Indeed, the present inventors have identified that a curved profile may provide a more reliable seal than a simple flat chamfered surface, because a curved profile is less vulnerable to distortion arising during manufacture due to 'ovality' effects that can cause a flat surface to warp and curve during cooling, as described more fully below.

Preferably, where the sealing surface has a convex curved profile, it's radius is between 1.5 mm to 1.8 mm, as measured from the centre point of its curvature at maximal curvature. The present inventors have identified that this range of radii provide a particularly good seal for a convex surface.

Preferably, where the sealing surface has a concave curved profile, the lowermost surfaces of the sealing surface define an angle between 20 degrees and 40 degrees, into which the liquid discharge element is received. More preferably, the angle is between 25 and 35 degrees, more preferably the angle is approximately 30 degrees. The present inventors have identified that this range of angles provide a particularly good seal for a concave surface.

Optionally, the liquid discharge element is moveable by a returning force from its liquid discharged position to its liquid primed position, optionally wherein the liquid discharge element is negatively buoyant in the liquid to be dispensed so as to provide at least a part of said returning force. This ensures the discharge element reliably returns to its liquid primed position after actuation.

Optionally, the liquid discharge element is comprised of at least one of the group consisting of: metal; steel, for example stainless steel; and a synthetic polymeric material. These materials are robust and result in minimal wear.

In a preferred embodiment, the liquid discharge element is comprised of a thermoplastic elastomer, more preferably a vulcanised thermoplastic elastomer such as Santoprene®. The inventors have identified that these materials produce particularly good sealing between the liquid discharge element and the sealing surface in the valve stem.

Preferably the liquid discharge element has a shore hardness of 40 to 70 as measured on the Shore D hardness scale. This ensures robustness whilst still permitting a good seal.

Preferably, the weight of the liquid discharge element is at least 0.03 g so as to ensure that the liquid discharge element reliably sinks under the action of gravity after it has discharged a metered volume.

Optionally, the liquid discharge element is spherical. A particular advantage of a sphere is that a sufficient seal is created between the liquid discharge element and the metering chamber, but friction between the wall of the metering chamber and the sphere is minimised, thus allowing the sphere to travel more freely than, for example, a cylindrical piston. Also, the manufacturing tolerances for a cylindrical piston are more demanding than a sphere because the sphere can roll and rotate within the chamber more freely than the former.

Optionally, the head portion of the valve stem projecting from the second end of the housing is moveable within an annular seal provided at the second end of the housing and said head portion has a third fluid transfer passageway communicating with an outlet of the head portion, said third transfer passageway being sealed to fluid flow in the first limit position of the valve stem and open to fluid flow in the second limit position thereof.

Optionally, the inlet to the housing is coaxial with the valve stem chamber.

Optionally, the bottom housing portion comprises an upstanding tubular spigot which encircles the inlet and projects upwardly into the interior of the housing, wherein the upstanding tubular spigot is dimensioned such that the discharge assembly is configured to discharge a metered volume of between 30 microliters and 150 microliters. This makes the discharge assembly suitable for a wide range of uses. The discharge volume can be straightforwardly altered by changing the height of the upstanding spigot.

According to a second aspect of the present disclosure, a liquid dispensing apparatus provided with a discharge assembly as described herein is disclosed, for discharging a metered volume of a liquid held in a pressurised or pressurisable container of the apparatus.

Optionally, the container is pressurised with nitrogen, air, liquefied natural gas, liquefied hydrocarbon gas or carbon dioxide.

Optionally, the apparatus is an aerosol spraying device.

Optionally, the apparatus contains a compound or composition comprising material selected from the group consisting of pharmaceutical, agrochemical, fragrance, air freshener, odour neutraliser, sanitizing agent, polish, insecticide, depilatory chemical (such as calcium thioglycolate), epilatory chemical, cosmetic agent, deodorant, anti-perspirant, anti-bacterial agents, anti-allergenic compounds, and mixtures of two or more thereof.

Advantageously, the disclosed assembly provides a liquid dispensing apparatus that can use compressed gas as a propellant, meaning that no harmful or environmentally damaging propellant gases (such as butane) need to be used. The apparatus can deliver uniform metered volumes of liquid propellant over its lifetime, is inexpensive to manufacture, is manufacturable within narrow performance tolerances with high manufacturing yield, and has componentry resistant to the effects of ageing over product lifetime. Further, the disclosed apparatus produces a high quality liquid aerosol without requiring a gas bleed from the aerosol container, thereby substantially maintaining aerosol spray performance throughout operational lifetime.

The apparatus in accordance with the present disclosure is preferably in the form of an aerosol spray device.

The liquid discharge element employed in the liquid dispensing apparatus of the present disclosure is preferably rigid to ensure that a known volume of liquid is dispensed without possible fluctuation in volumes as between successive discharges due to flexibility of the liquid discharge element.

In preferred constructions of the apparatus in accordance with the present disclosure, the apparatus is configured such that movement of the liquid discharge element (which is preferably in the form of a cylindrical piston or ball as noted above) from its liquid primed position in the metering chamber to its liquid discharged position is effected against the returning force. In other words, the returning force is applied during discharge of the apparatus and not only during recharging thereof. Conveniently the returning force is provided by virtue of the liquid discharge element being negatively buoyant in the liquid to be dispensed so that it has a tendency to "sink" within the metering chamber. The liquid discharge element may, for example, be of a metal such as stainless steel. Alternatively it may be of a synthetic polymeric material which is appropriately weighted (e.g. by means of metal inserts or by the incorporation therein of a densifying agent), preferably so as to have a weight of at least 0.03 g. Alternatively or additionally, the returning force may be provided by a spring.

The metering chamber is preferably provided within the valve stem with the liquid discharge element being moveable along an interior surface of the metering chamber. Preferably the liquid discharge element is in the form of a piston which is preferably spherical or cylindrical. If the apparatus is to be used for metering accurate volumes (e.g. for medical purposes) then the liquid discharge element may be sealed against the valve stem and/or against the inner wall of the metering chamber. Preferably, the clearance between the liquid discharge element and the metering chamber is sufficient to create a seal between the liquid discharge element and the metering chamber, but not too small that the travel of the liquid discharge element between the first and second limit position is significantly impeded by friction with the wall of the metering chamber.

Preferred constructions of the apparatus in accordance with the present disclosure will be such that the liquid discharge element has a first side exposed to the metering chamber and an opposite second side exposed to fluid pressure from the container. In such an arrangement, the metering chamber will be provided on the first side of the liquid discharge element with an inlet/outlet arrangement for introduction of liquid from the container into the metering chamber and for discharge of liquid from the metering chamber. In some embodiments of the invention, the inlet and the outlet may be separate of each other. However in other embodiments of the invention a single port may serve as both an inlet and an outlet.

Generally apparatus in accordance with the present disclosure will incorporate an actuator assembly incorporating a valve stem in which for the movement from a first limit position to a second limit position is preferably against biasing means (e.g. a coil spring). The actuator assembly preferably incorporates a valve stem. The actuator assembly may further incorporate an actuator cap.

In preferred embodiments of the present disclosure, the valve stem has a discharge conduit arrangement with an inlet through which liquid is introduced into the discharge conduit arrangement and an outlet from which liquid is discharged from the apparatus. Such an embodiment also incorporates a valving arrangement which is such that wherein the valve stem is in its first limit position liquid may flow into the metering chamber from the pressurised container through the inlet/outlet arrangement to effect charging of the metering chamber and may not flow out of the metering chamber through the inlet/outlet arrangement. Conversely when the valve stem is in its second limit position, liquid may flow out of the metering chamber to the discharge conduit through the inlet/outlet arrangement to effect discharging of the metering chamber and may not flow into the metering chamber through the inlet/outlet arrangement.

A pressure equalising channel may be provided in the exterior surface of the metering chamber to allow for equalisation of the pressure in the discharge conduit arrangement of the valve stem and that in the container when the valve stem is in the first limit position.

The valve stem may be rotatable about its axis between first and second rotary positions and wherein the apparatus is such that axial movement of the valve stem beyond its second limit position is prevented in the first rotary position of the valve stem but allowed in the second rotary position thereof to provide for filling and/or re-filling of the apparatus. Advantageously the requirement of such rotation of the axis to enable filling and/or re-filling of the apparatus prevents accidental depression of the valve stem into the filling position by the user during normal use.

Locating the metering chamber within the valve stem has the advantage of simplifying construction as compared to the case where the metering chamber is provided around the valve stem (around the periphery thereof). Advantageously such a metering chamber may be particularly suitable for providing an apparatus with a metering chamber having a small and accurate metered volume. The valve stem may be biased from the second limit position to the first limit position, preferably with a spring, most preferably a coil spring.

Preferably, a lower wall of the housing is provided with a depending spigot defining an inlet for the housing. Liquid from the pressurised container preferably enters the housing through this spigot. Preferably the spigot extends from a lower wall of the housing and is capable of engaging with at least a portion of the valve stem. Preferably the coil spring is located on the spigot such that when the valve stem is in the second limit position, the spring biases the valve stem towards the first position.

Preferably a seal is provided at the end of the housing from which a portion of the valve stem projects. Preferably the seal is an annular seal which seals around the circumference of the valve stem at the point at which it exits the housing. The seal is such that it allows relative slidable movement of the valve stem within the housing and between the first and second limit positions.

Preferably the metering chamber has a substantially cylindrical cross section.

Preferably the diameter of the liquid discharge element closely approximates that of the metering chamber, thereby providing a sealed or almost sealed contact with the internal circumference of the metering chamber.

Preferably the valve stem comprises a body portion and a narrower diameter head portion. The head portion is preferably encircled at its base by a shoulder defined at the upper end of the body. The head portion is preferably moveable within an annular seal provided at the second end of the housing. Preferably the head portion has a third fluid transfer passageway communicating with an outlet of the head portion, said third transfer passageway being external of the housing in the first position of the valve stem and within the housing in the second position thereof. Preferably the inlet to the housing is coaxial with the chamber.

Preferably the discharge assembly of the present disclosure is such that with the valve stem in its second limit position and the discharge element at its liquid primed position there is a refill flow passageway arrangement between the liquid inlet of the housing and the chamber provided within the body of the valve stem to permit re-filling of a container on which the discharge assembly is mounted in use.

DETAILED DESCRIPTION

The invention of the present disclosure will be further described by way of example only with reference to the accompanying drawings, in which.

Figure 1A:
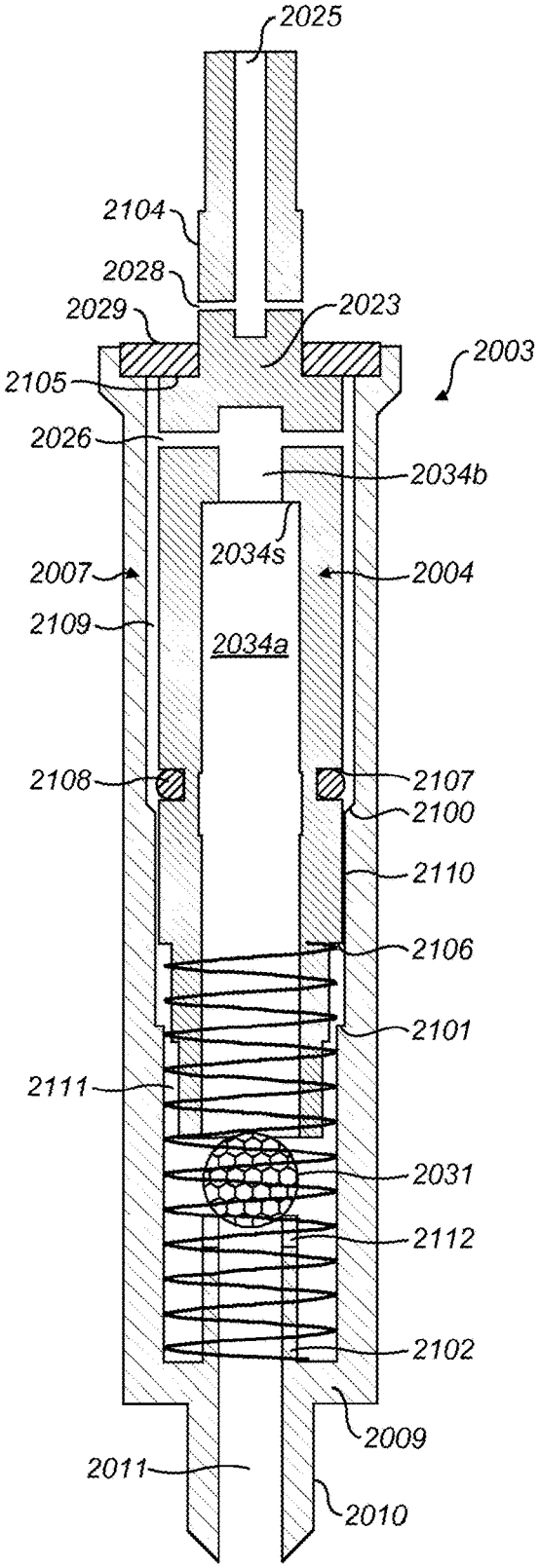
FIG. 1A (PRIOR ART)
FIGS. 1A and 1B show a prior art arrangement of a discharge assembly in successive stages of operation.

In the following description, references to "upper" and "lower" are to the embodiments of the apparatus as illustrated in the drawings which are represented in their normal operational positions. References to "top" and "bottom" are to be interpreted similarly and as analogous to "upper" and "lower" respectively. In the following description, the "rest" condition is that in which the apparatus is primed and ready to emit a metered volume, with the valve stem in the uppermost position and the piston (i.e. the discharge element) in the lower limit position. Ranges, such as expressed as between a first and second end point, should be interpreted as encompassing (i.e. being inclusive of) those end points.

In the following description, references to the valve stem being in the uppermost and lowermost positions correspond respectively with references to the valve stem being in first and second limit positions. References to the valve stem being in the depressed or actuated position correspond with references to the valve stem being in the lowermost position. References to a piston correspond with references to a liquid discharge element. References to the lower and upper limit positions correspond respectively with references to liquid primed and liquid discharged positions.

It should be appreciated that other than substantially insoluble compressed gas propellants, liquefied gas propellants may be used in the embodiments of the invention. It will be appreciated that the liquid discharge assembly as disclosed herein is particularly suitable for use in the liquid dispensing apparatus as generally defined herein.

Referring now to FIG. 1A, there is shown an embodiment of a prior art discharge (or metering valve) assembly 2003 in its rest condition. To provide context for the improved valve assembly of the present disclosure, the functionality of this prior art assembly will be described in detail. The deficiencies in this assembly and the manner in which these deficiencies are addressed by the improved valve of the present disclosure will then be described.

Turning again to FIG. 1A, the metering valve assembly 2003 comprises a housing 2007 within which valve stem 2004 is located. Housing 2007 is generally tubular and has an inner surface that is stepped at two positions along its length. More particularly, the inner surface of housing 2007 has a downwardly inclined, annular step 2100 and a right angled step 2101 further down towards the wall 2009 at the lower end of the housing.

Lower wall 2009, which may also be considered a base portion of the housing 2007, is provided with a depending spigot 2010 defining an inlet 2011 for the housing 2007. Spigot 2010 may optionally have an enlarged lower end (not shown) on which is located the upper end of a dip-tube (not shown) that extends to the lower region of a container (not shown) onto which the metering valve assembly 2003 is mounted in use. An upstanding tubular spigot 2102 encircles the inlet 2011 and projects upwardly into the interior of the housing 2007.

Valve stem 2004 comprises a body portion 2103 and a narrower diameter head portion 2104 encircled at its base by a shoulder 2105 defined at the upper end of body 2103. At the junction of body portion 2103 and head portion 2104 is a partition wall 2023 which separates an upper, open-topped conduit 2025 (in head portion 2104) from lower chambers 2034*a* and 2034*b* provided in body portion 2103. As shown, chamber 2034*b* is the upper of these two chambers and of lesser diameter whereby a shoulder 2034*s* is defined in going from chamber 2034*a* to 2034*b*.

Over the majority of its length, body portion 2103 of valve stem 2004 has an outer diameter marginally less than the inner diameter of housing 2007 in the region thereof between steps 2100 and 2101. In its lower region, body portion 2103 is stepped inwardly as at 2106.

Valve stem 2004 is provided with two sets of fluid transfer passageways, one set extending radially outwardly from the discharge conduit 2025 and the other set radially outwardly from chamber 2034*b*. More particularly, in its upper region, the body 2103 (of the valve stem 2004) is formed with first fluid transfer passageways 2026 and a lower region of the head portion 2104 is formed with second fluid transfer passageways 2028.

Additionally, body portion 2103 (of the valve stem 2004) is formed with an annular groove 2107 in which locates an O-ring 2108. The external diameter of O-ring 2108 is less than the internal diameter of housing 2007 above step 2100 but slightly greater than the internal diameter below step 2100.

Figure 1B:
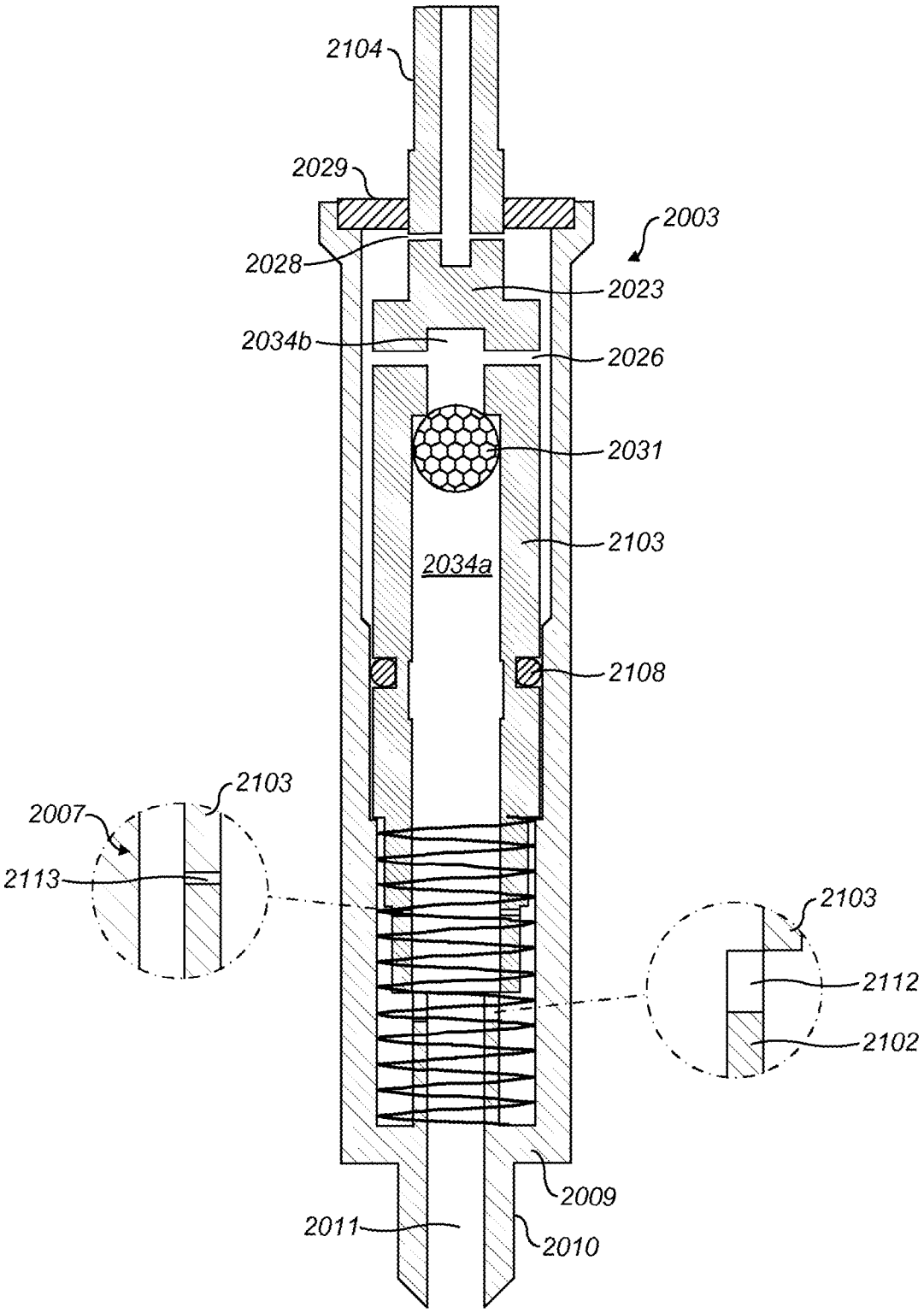
FIG. 1B (PRIOR ART)

As shown in FIGS. 1A and 1B, valve stem 2004 is located with its body 2103 within housing 2007 and its head 2104 projecting beyond an annular seal 2029 which is provided at the upper end of housing 2007 and seals against the external surface of the head 2104. As further shown in the drawings, the body 2103 of valve stem 2004 sub-divides the interior volume of housing 2007 into a first annular region 2109 above step 2100, a narrower second annular region 2110 between steps 2100 and 2101 and a third annular region 2111 below step 2101.

Valve stem 2004 is of a length such that, when the metering assembly 2003 is in its rest condition (as shown in FIG. 1A) the lower end of valve stem 2004 locates above the upper end of spigot 2102. A coil spring provided around spigot 2102 and around the lower end of valve stem 2004 serves to bias the latter to its upper position.

A ball 2031, which is negatively buoyant relative to liquid held within a container for discharge by the assembly 2003 is provided as shown. Ball 2031 has a diameter greater than the internal diameter of tubular spigot 2102 but such as to locate with minimal clearance within lower chamber 2034*a* of valve stem 2004. In the rest condition of the assembly 2003 (see FIG. 1A), ball 2031 rests on the upper end of tubular spigot 2102 with its upper surface lying just within the lower end of chamber 2034*a*.

With the arrangement as described, ball 2031 is capable of travel between a lower limit position (defined by the upper end of tubular spigot 2102) and an upper limit position at shoulder 2034*s*. Accordingly the lower chamber 2034*a* provides a metering chamber within which ball 2031 is able to move from its lower to upper limit position to sweep out a metered volume.

Further features of the illustrated embodiment are one or more cut-away portions or slots 2112 at the upper end (as seen in FIGS. 1A and 1B) of the spigot 2102 and slots 2113 or other passageways for providing fluid flow radially through the wall towards the lower end of the body portion 2102. More particularly, the slots 2113 (or other passageways) are provided at a level such that with the valve stem 2004 in the depressed position (FIG. 1B) and the ball 2031 seated on the spigot 2102, fluid is able to flow radially outwardly of the body 2103 of valve stem 2004 for the reasons described more fully below.

FIG. 1B shows the assembly of FIG. 1A in its actuated position. Operation of the illustrated device according to FIGS. 1A and 1B, i.e. from rest to actuation, is as follows.

In the rest condition illustrated in FIG. 1A, the ball 2031 is at its lower limit position and the metering valve assembly 2003 is filled with liquid up to the level of seal 2029. Once valve stem 2004 is depressed, the fluid transfer passageways 2028 move downwardly past the seal 2029 so as to be open to fluid flow from within the housing 2007. Additionally O-ring 2108 now acts against the inner surface of second annular region 2110 so as to prevent fluid flow from the inlet 2011 into the first annular region 2109. As a result, ball 2031 is now forced upwardly by fluid pressure so that it moves from its lower limit position (shown in FIG. 1A) to its upper limit position (shown in FIG. 1B) and in doing so causes a metered volume of liquid to be transferred radially outwardly through fluid flow transfer passageways 2026 and then radially inwardly through fluid flow transfer passageways 2028 for discharge by the assembly via outlet 2025. Once the valve stem 2004 is released and it returns to its uppermost position under the action of the spring, the fluid transfer passageways 2028 again become closed to fluid flow (by virtue of locating above seal 2029) but liquid is now able to pass from the inlet 2011 of the housing along the annular regions 2109, 2110 and 2111 to reach the fluid transfer passageways 2026. This liquid is able to pass radially inwardly along fluid transfer passageways 2026 above the level of ball 2031, which will now move downwardly to its lower limit position so that chamber 2034*a* is primed for a further discharge of a metered volume of liquid.

Once the container on which the spray discharge assembly is mounted has been depleted of liquid and gas it may be refilled in the following manner. Firstly, the valve stem 2004 is depressed so as to be in the position shown in FIG. 1B. Secondly, a pressurised source of liquid and/or propellant gas (as the case may be) is connected to (what would normally be) the outlet end of valve stem 2004. As a result, the refill liquid and/or propellant gas passes along discharge conduit 2025, radially outwardly through the second fluid transfer passageways 2028 into the annular region 2109 before passing radially inwardly through passageways 2026. If the ball 2031 is not already seated on spigot 2031, the fluid pressure causes it to move to this position. The pressurised refill liquid and/or propellant gas passes along chamber 2034*a* and then radially outwardly through the slots 2113 and subsequently radially inwardly through the cut-away portions 2112 so it may pass into the container through inlet 2011.

Figure 2A:
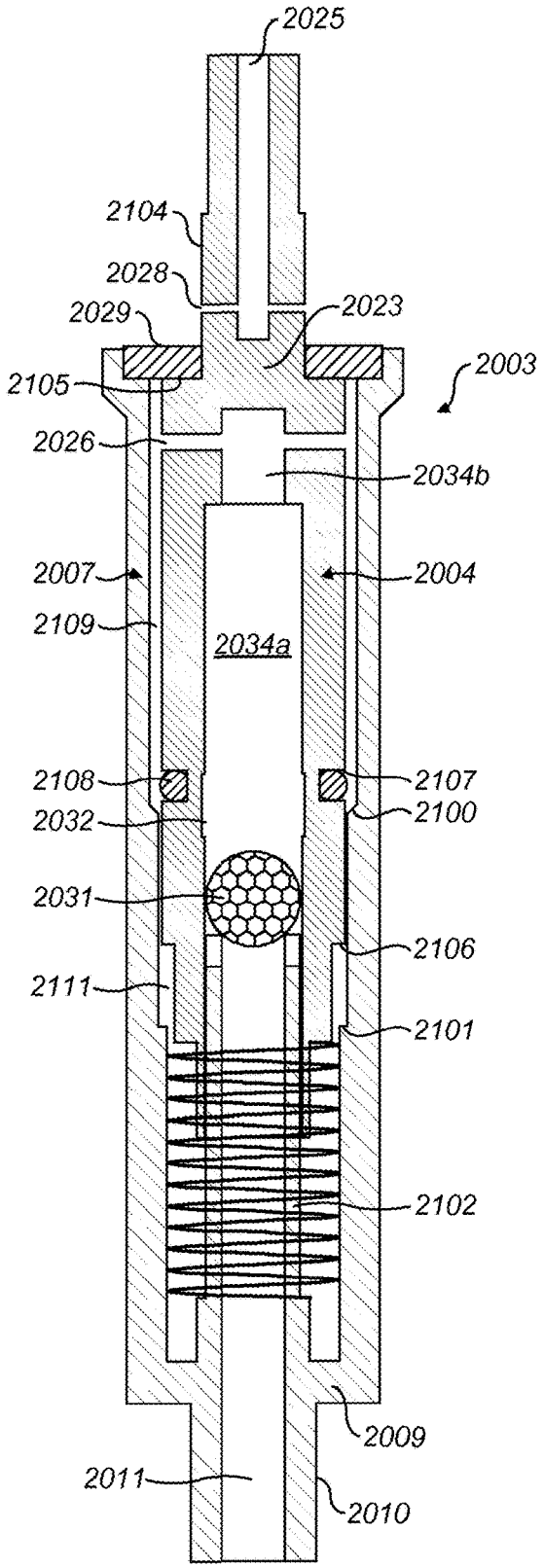
FIG. 2A (PRIOR ART)
FIGS. 2A, 2B and 2C show a further prior art arrangement of a discharge assembly in successive stages of operation.
Figure 2B:
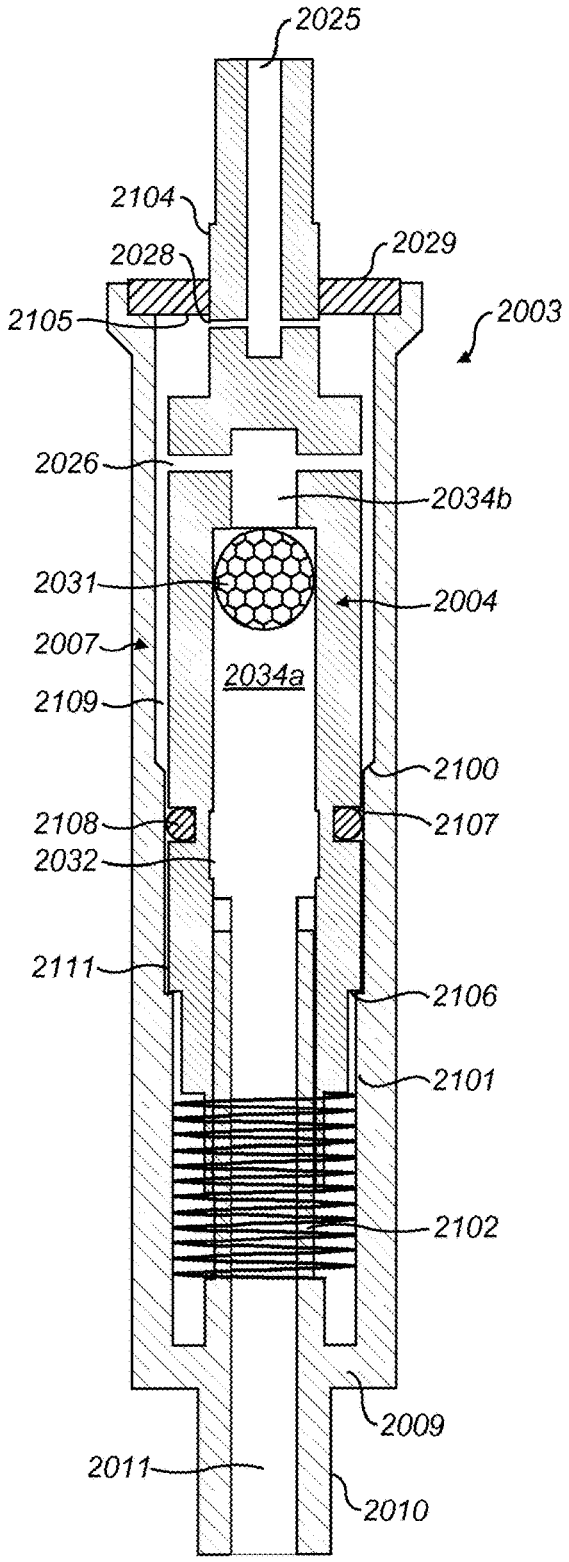
FIG. 2B (PRIOR ART)

FIGS. 2A and 2B show a similar embodiment to that shown in FIGS. 1A and 1B. In this embodiment, valve stem 2004 is of a length such that, when the metering assembly 2003 is in its rest condition (as shown in FIG. 2A) the lower end of valve stem 2004 locates below the upper end of spigot 2102. The spigot can be slidably inserted into the lower end of valve stem 2004. A coil spring provided around spigot 2102 and around the lower end of valve stem 2004 serves to bias the latter to its upper position.

Figure 2C:
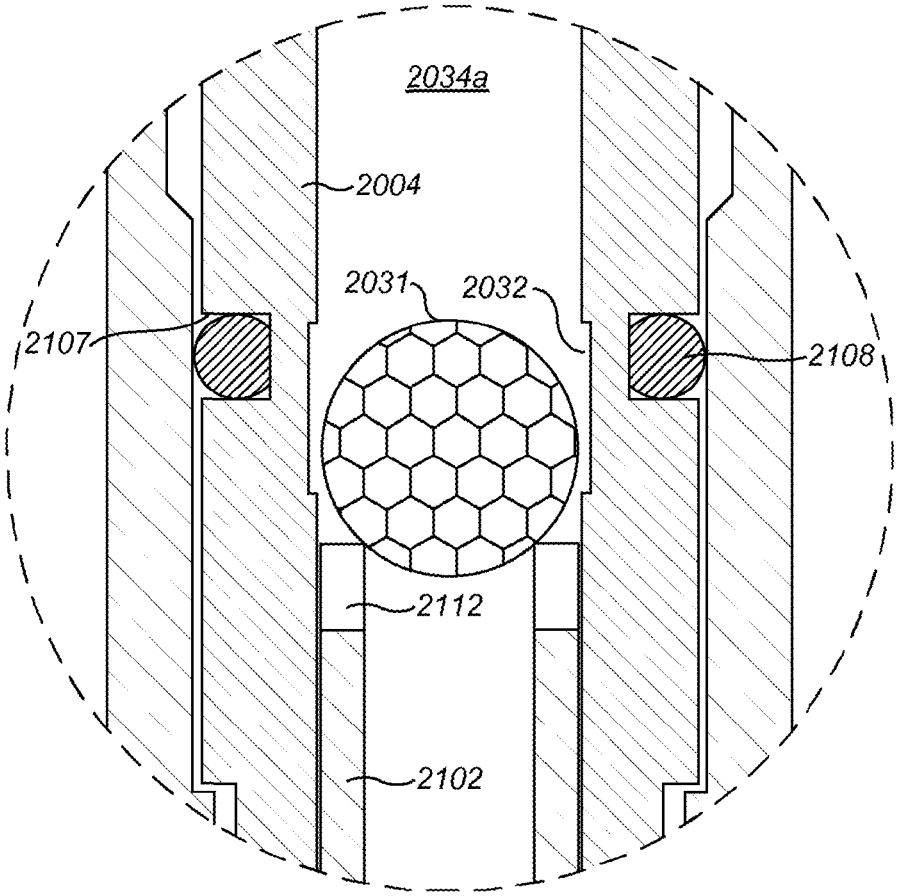
FIG. 2C (PRIOR ART)

It will be appreciated that the device shown in FIGS. 2A-2C works analogously to that of FIGS. 1A and 1B. The principal difference is that pressure equalization between the pressurised container and the upper chamber 2034*b* is facilitated by the fluid being able to move between the interface of the outer surface of the spigot 2102 and the inner surface of the metering chamber 2034*a*. This may be achieved by providing adequate clearance between the outer diameter of the spigot 2102 and the inner diameter of the metering chamber 2034*a*. This may be alternatively or additionally achieved by providing grooves in the outer surface of the spigot 2102 which provide one or more conduits which run between the metering chamber 2034*a* and the annular regions 2111 and/or by providing inlets in the valve stem wall such as passageways 2113 shown in FIG. 1B. In this manner, fluid is able to move up inlet 2011 into chamber 2034*a*, through slots 2112, into annular regions 2111, 2110 and 2109 to reach fluid transfer passageways 2026. As this is above the level of ball 2031, the ball will move downward, ready for a further discharge of a metered volume of fluid.

Refilling of the apparatus of FIGS. 2A and 2B is performed similarly to that of FIGS. 1A and 1B, with the addition that in some embodiments an annular groove may further facilitate refilling, as shown in close up in FIG. 2C. As shown, the wall of the chamber 2034*a* has an annular groove 2032 which has a greater diameter than the rest of the chamber. This annular groove 2032 facilitates refilling of the apparatus as follows. Firstly, the valve stem 2004 is depressed so as to be in the position shown in FIG. 2B. It can then be depressed past this position (for example by rotating the valve stem to a predetermined position) and depressed further such that the upper end of the spigot 2102 will hold the ball 2031 adjacent to the annular groove (as shown in FIG. 2C). Secondly, a pressurised source of liquid and/or propellant gas (as the case may be) is connected to (what would normally be) the outlet end of valve stem 2004. As a result, the refill liquid and/or propellant gas passes along discharge conduit 2025, radially outwardly through the second fluid transfer passageways 2028 into the annular region 2109 before passing radially inwardly through passageways 2026. The fluid pressure causes the ball 2031 to move to the position shown in FIG. 2C. The pressurised refill liquid and/or propellant gas passes along chamber 2034*a*, past the ball 2031 at the annular groove, and then radially through the slots 2112 so it may pass into the container through inlet 2011. It will be appreciated that inclusion of groove 2032 is optional and the assembly of FIG. 2A/2B can alternatively be refilled in the manner described with respect to FIGS. 1A/1B.

With regard to the embodiment shown in 2A-2C, the clearance between the outer diameter of the spigot 2102 and the inner wall of the metering chamber 2034*a* is sufficient to allow a flow of fluid from the metering chamber 2034*a* to the annular space 2111, and hence provide fluid communication between the metering chamber 2034*a* and the fluid flow transfer passageways 2026 when the ball 2031 is in the liquid discharged position as shown in FIG. 2B. This permits equalization of the pressure between the pressurised container and the upper chamber 2034*b*, thus facilitating the movement of the ball 2031 back towards the spigot 2102.

The present inventors have identified a number of significant deficiencies in the prior art discharge assemblies of FIGS. 1A-2C, as will now be explained.

Firstly, the present inventors have identified that insertion of O-ring 2108 during manufacture of the valve creates significant difficulties. Manufacturing the required groove 2107 to seat the O-ring requires a high degree of precision to ensure the O-ring protrudes from the valve stem by the correct distance to create an effective seal against the housing 2007 in the actuated position. This procedure has a very demanding tolerance, meaning that even a slight deviation from the intended groove or O-ring dimensions can result in failure of the valve mechanism. Inserting the O-ring 2108 into the groove 2107 is also a cumbersome and high precision task which increases manufacturing time. Further, the present inventors have identified that even once O-ring 2108 is seated correctly, it has a tendency to swell up during usage due to exposure to fluid. This may cause the valve to jam and become dysfunctional. Hence, inclusion of O-ring 2108 presents a variety of difficulties. The present inventors have considered replacing the O-ring with a solid bead of resin or plastic, to address the above-described problems with using an O-ring. However, this too presents issues because the bead must be very precisely located and dimensioned so that it forms the correct seal during actuation. This is not straightforward, because moulded parts suffer from a phenomenon known as 'ovality'. This is when moulded parts (particularly rounded ones) have a tendency to stretch and take on an oval shape rather than the intended spherical shape. In the context of the present discharge assembly, such ovality can lead to the sealing bead being the wrong shape to correctly seal the valve during actuation. As a result, moulding times must increase to offset ovality and failure rates of valves are high, resulting in many valves that are discarded after manufacture due to not being fit for purpose. Ovality of the sealing bead can also make it difficult to remove the moulding pin during manufacture. The present inventors have recognised that a superior sealing mechanism is required.

A further deficiency with the discharge arrangement of FIGS. 1A-2C is that the valve stem and housing must be of a minimum length to be able to hold, and subsequently discharge, a useful volume of fluid. Typically, metered valve arrangements of this nature are between 30 mm and 40 mm long. This is in contrast to non-metered dose valving arrangements which can discharge a continuous stream of fluid and therefore be much shorter, typically around 10 mm long. A long valve stem and housing means that the base portion of the housing (i.e. base portion 2009 in FIGS. 1A-2C) must be thick, so as to have sufficient structural integrity to support the walls and other features provided in the housing. The present inventors have identified that when using the arrangement shown in FIGS. 1A-2C, base portion 2009 must be at least 3 mm thick. This thickness is undesirable, because thick portions of material take longer to cool during the moulding process. This means there is a greater time period during which deformation can occur, and the risk of this only increases when a moulding pin must be extracted during moulding. To mitigate this, the moulding pin is typically left in the mould for longer, to allow the plastic material longer to cool. However, this greatly increases cycle times of the manufacturing process. The present inventors have identified that when using the arrangement shown in FIGS. 1A-2C, the manufacturing cycle time for producing the discharge assembly is around 40 seconds due to the need to wait for the base portion to cool. The present inventors have recognised that a superior structure for the valve housing is required.

A third deficiency with the discharge arrangement of FIGS. 1A-2C is that the stroke length of the discharge assembly is very limited, at around 0.2 mm. The "stroke length" in this context is the maximum distance by which the valve stem can be depressed into the housing during actuation. The reason the stroke length is so restricted in the above-described arrangement is that the O-ring (or resin bead) only seals at a single point along the housing, namely at the point of contact between the O-ring (or bead) and the valve housing. This contact point is very small, meaning that the dimensions of the valve need to be very precise to ensure correct sealing when the fluid outlet is opened to fluid flow. This restricts the stroke length. Further, a long stroke length would lead to a significant degree of rubbing between the point of contact of the O-ring or bead and the valve housing because the point of contact is very small, meaning that all frictional forces are applied to said single point of contact. This can quickly degrade either the O-ring, bead, housing or both leading to failure of the valve assembly. Accordingly, only a very short stroke length is possible so as to minimise rubbing of the O-ring/bead against the housing. The present inventors have recognised that an increased stroke length is required to allow for a greater variety of applications of the assembly, as described more fully below.

A fourth deficiency with the discharge arrangement of FIGS. 1A-2C is that the surface against which the ball 2031 seals (i.e. shoulder 2034*s*, visible in FIG. 1A) must be precisely machined. This is because the shoulder has a sharp, right-angle edge. When machined correctly, this creates an effective seal against the ball in the actuated (liquid discharged) position. However, the present inventors have discovered that in practice it is in fact very difficult to obtain a sharp, right-angular edge at this sealing surface. In many cases, small deformities in the moulding occur. This can ruin the sharpness of the edge, resulting in poor sealing or even a failed seal altogether. This results in a continuous stream of discharge rather than a metered dose. The present inventors have recognised that a superior sealing surface geometry is required.

Finally, a fifth deficiency with the discharge arrangement of FIGS. 1A-2C is that the present inventors identified that during manufacture the moulding pin would frequently get stuck in the components being moulded. This is because, as noted above, metered discharge assemblies are longer than typical valve assemblies because they need to have sufficient interior volume to hold the required metered dose. This results in a long housing and long valve stem, in which the moulding pin is more liable to become stuck due to high frictional forces. The present inventors have recognised that an improved moulding process is required.

An improved discharge assembly for discharging a metered volume of a liquid which addresses the above-described shortcomings of the prior art valve will now be described, with reference to FIGS. 3-15.

Figure 3:
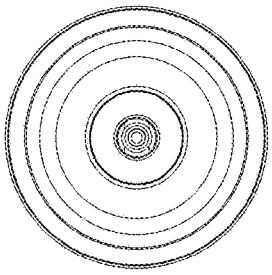
FIGS. 3-5 show an improved arrangement of a discharge assembly according to the present disclosure.
Figure 4:
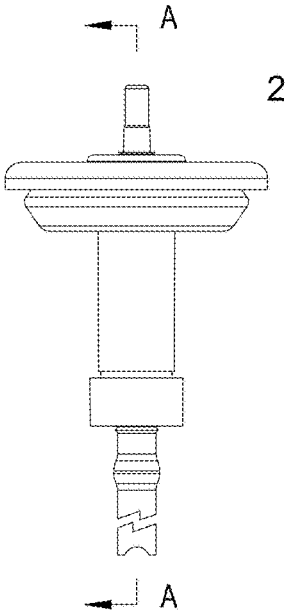
Figure 5:
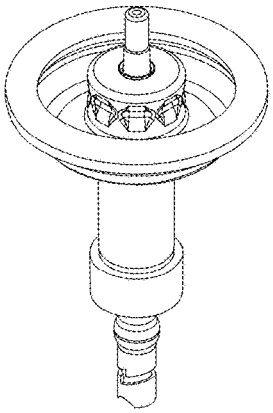
Figure 6A:
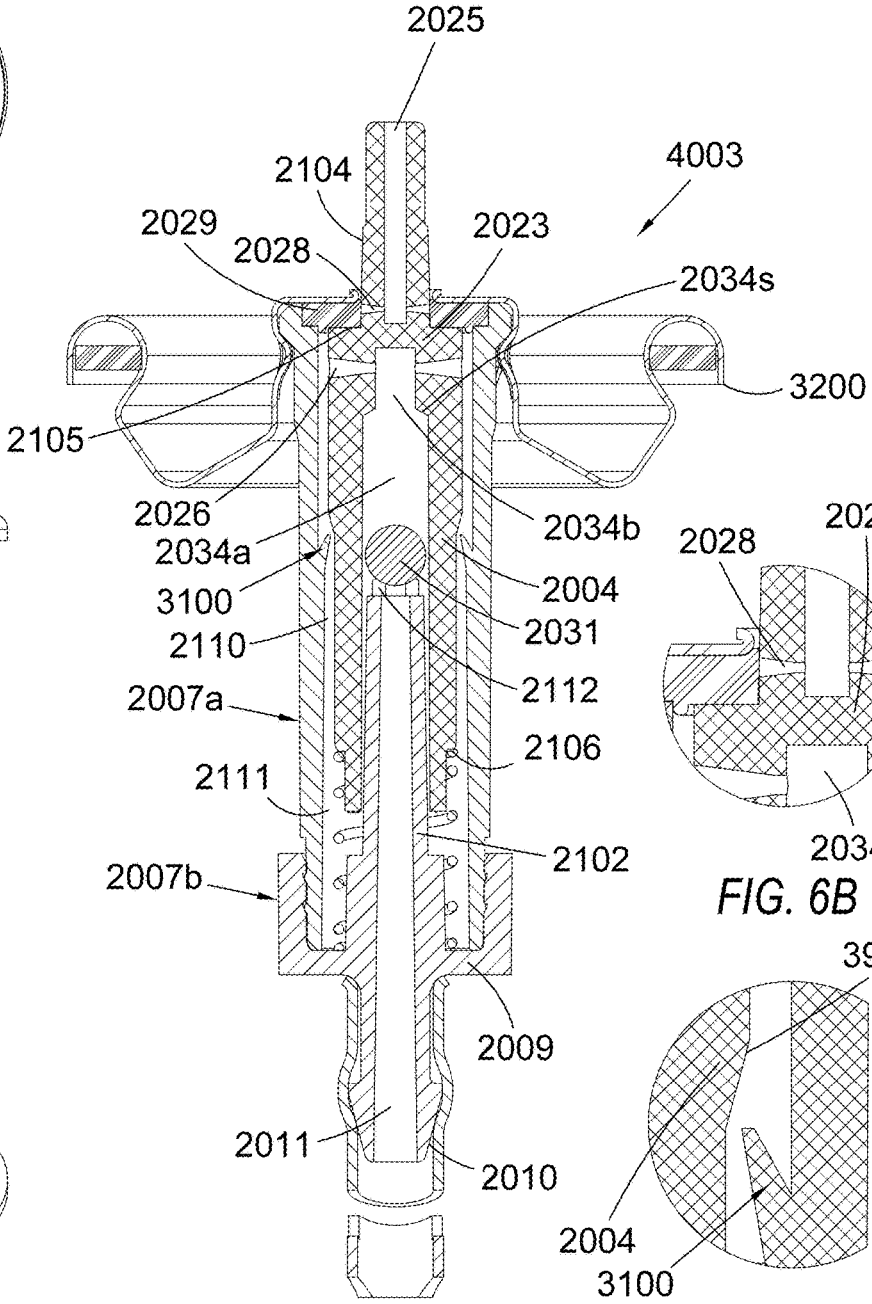
FIGS. 6A-6C show the improved discharge assembly in its rest position in cross-section.
Figure 6B:
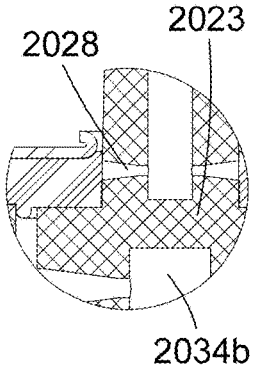
Figure 6C:
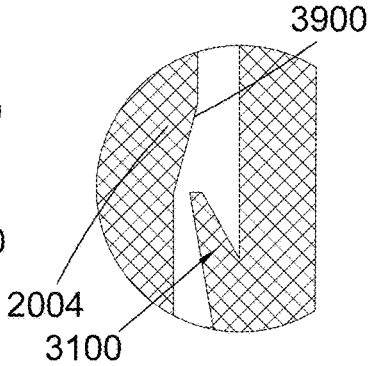

Turning first to FIGS. 3, 4 and 5, the improved discharge assembly 4003 is shown from a top-down, side-on and perspective view. A cross-sectional view of the improved discharge assembly 4003 is shown in FIG. 6A, with two close-up portions shown in FIGS. 6B and 6C. FIGS. 6A-6C correspond to view A-A shown in FIG. 4. The assembly shares various structural features in common with the discharge assembly of FIGS. 1A-2C, and like reference numerals are used to indicate like components. Save for the differences about to be described, the actuation mechanism and fluid flow paths during actuation and reset are as described above with reference to FIGS. 2A and 2B.

Nevertheless, various key modifications compared to the valve of FIGS. 1A-2C are provided to address the problems with the previous arrangement, outlined above. These improvements will now be described in detail.

Figure 7A:
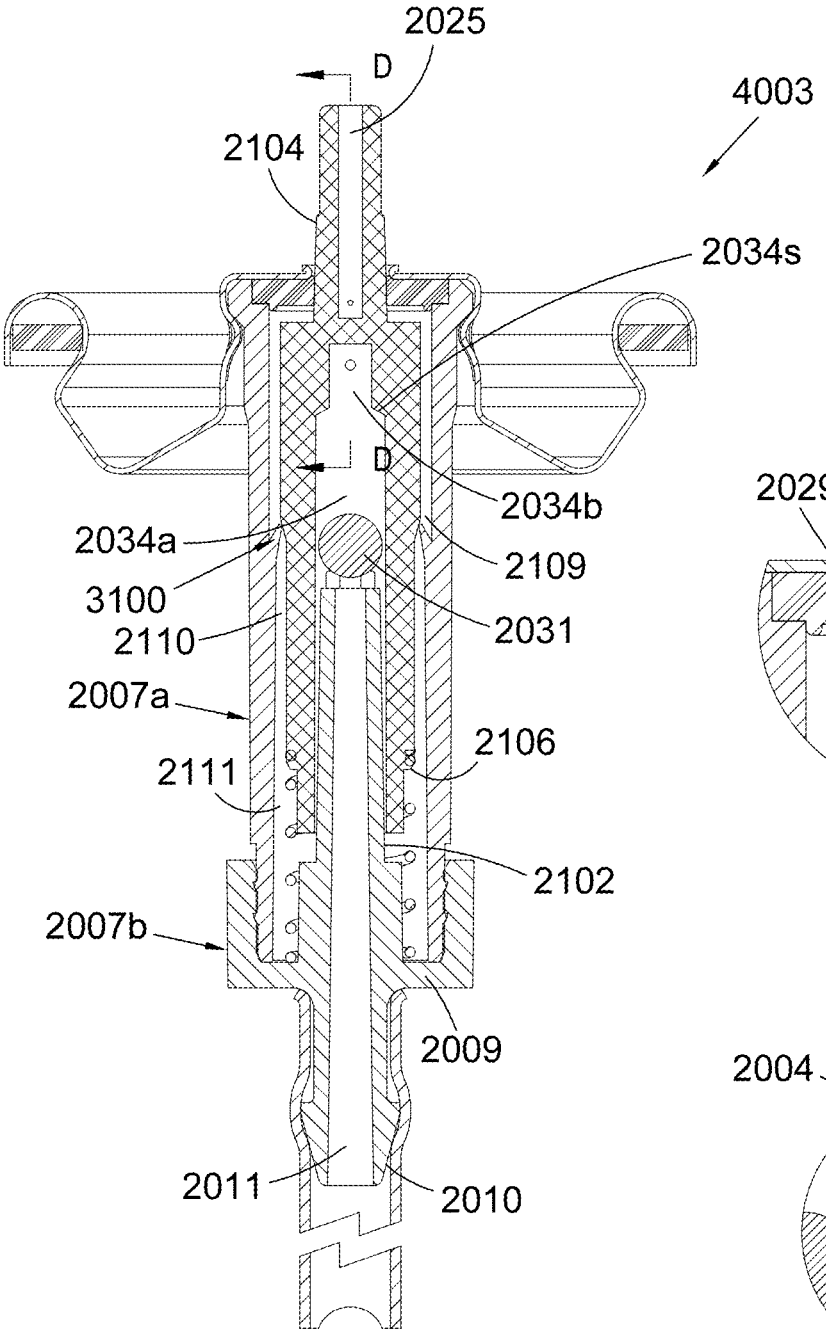
FIGS. 7A-7C show the improved discharge assembly in an intermediate, part-actuated position in cross-section.
Figure 8A:
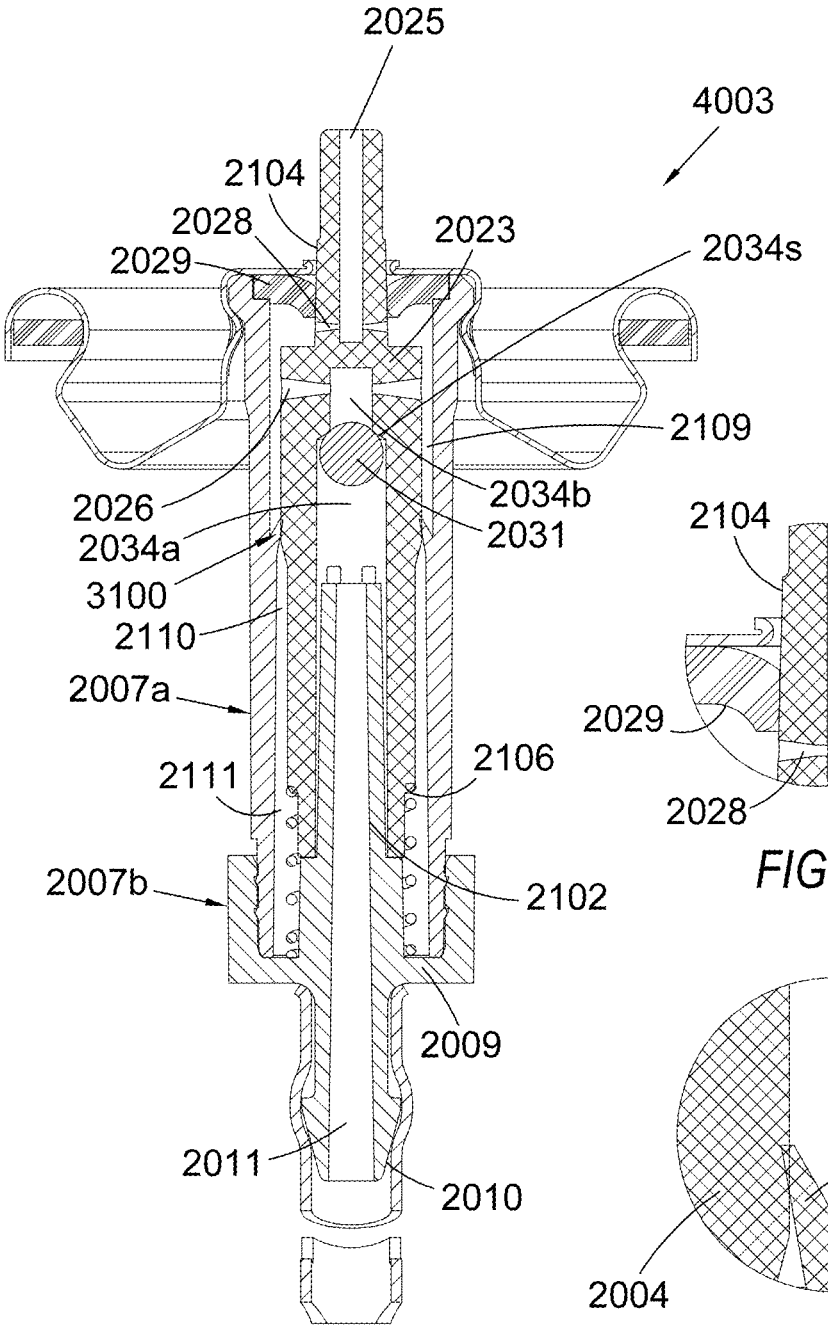
FIGS. 8A-8C show the improved discharge assembly in its fully actuated position in cross-section.

Firstly, rather than a single-piece housing as utilised in the prior design, the improved assembly utilises a two-part housing. In particular, an upper (or top) housing portion 2007*a* is secured to a lower (or bottom) housing portion 2007*b*. Upstanding spigot 2102 is part of the lower housing portion 2007*b*, while the majority of the outer wall of the housing is provided as part of the upper housing portion 2007*a*. Upper housing portion 2007*a* is also configured for attachment to a mounting cup 3200, as shown in FIGS. 6A, 7A and 8A.

The structure of the improved valve assembly 4003 means that base portion 2009 is not required to provide the same degree of structural integrity compared to the design of FIGS. 1A-2C. In particular, by virtue of being a two-part housing, top portion 2007*a* bears some of the structural load of the housing. This means that bottom portion 2007*b* bears less of a load and does not need to provide as substantial a structural foundation. As a result, base portion 2009 can be significantly thinner—generally no more than 2 mm thick and preferably between 1 mm and 2 mm thick. As a result of these thinner dimensions, made possible by the improved structural arrangement of this discharge assembly 4003, the risks of deformation of the base portion 2009 during moulding are significantly decreased. This means that the moulding pin can be removed more quickly, reducing the cycle time, and that less material needs to be used.

In the example arrangement shown in FIGS. 6A-6C, the top housing portion 2007*a* and the bottom housing portion 2007*b* are joined by a permanent interference fit. "Permanent" in this context means that the seal is not broken by normal use (e.g. actuation) of the device. In other words, the top and bottom housing portions remain fixed together during use of the device. In the arrangement shown, the bottom housing portion 2007*b* comprises a channel 3400 configured to receive the top housing portion 2007*a*. The channel is more clearly visible in FIG. 14. This channel 3400 provides a simple mechanism by which the interference fit between the housing portions can be established. In the present example, the channel further comprises recesses 3500 configured to receive corresponding protuberances 3300 on the top housing portion 2007*a*. It will be appreciated that alternatively or additionally the channel may comprises protuberances configured to interface with corresponding recesses on the top housing portion 2007*a*. When inserted together, the protuberances and recesses lock together to provide the permanent interference fit. It will be appreciated that other forms of interference fit can be provided. Preferably, the interference fit is configured to withstand an applied force of 100N. This will ensure that the seal will hold during normal use of the valve, including discharge (such as by an actuator of an automated discharge system) and refilling.

A second improvement over the previous discharge assembly is that, rather than an O-ring or sealing bead, the improved discharge assembly utilises a fin 3100. The fin 3100 can be seen in the cross section of FIG. 6A and is shown in closeup in FIG. 6C. The fin 3100 creates a temporary interference seal between the interior of the housing and the exterior of the valve stem 2004 during actuation, so as to close the fluid transfer passageway along the outside of the valve stem 2004 to fluid flow.

More specifically, the temporary seal is created when the valve stem is in its second limit position, as discussed above in relation to FIGS. 1A-2C in the context of the O-ring. In this context, "temporary" means that the seal is formed and broken during normal use. In this case the seal forms when the valve stem 2004 is depressed during actuation and moves towards its second limit position. The seal then breaks when the actuation force is removed and the valve stem 2004 returns to its first limit (i.e. rest) position. This cycle of sealing and un-sealing then repeats every time the valve is actuated. This temporary interference seal is thus to be contrasted with the permanent interference seal between the top and bottom housing portions, which persists throughout actuation and the reset to rest position.

In the example shown in FIGS. 6A-8C, as in the case of FIGS. 1A-2C, the temporary seal between the fin 3100 and valve stem 2004 is created to close off fluid flow between volumes 2111, 2110, and 2109 which surround the valve stem 2004. It will be appreciated that in this arrangement, the first annular region 2109 is above chamfered seat 3900 (which is provided on the valve stem 2004 in this example), annular region 2110 is between seat 3900 and step 2106, and annular region 2111 is below step 2106.

As shown in FIGS. 6A and 6C in particular, the fin 3100 comprises a lip of material which extends from the surface on which it is provided, typically at an acute upward or downward angle. In the arrangement shown, the fin 3100 is provided on the interior surface of the top housing portion 2007*a*, and projects into the housing interior at an acute upward angle. The fin 3100 is thereby configured to abut and seal against the exterior of the valve stem 2004 during actuation. It will be appreciated that in some arrangements the fin 3100 may be provided on the exterior of the valve stem 2004 and be configured to abut against the interior of the housing. Preferably, the fin 3100 is integral with the top housing portion 2007*a* (or with whichever component it is formed on). This simplifies manufacturing as the fin 3100 can be moulded at the same time as the housing (or valve stem, as the case may be). This facilitates faster cycle times than if the fin 3100 were to be a separate component attached at a later time.

To provide an improved seal, the arrangement shown further comprises a seat 3900 configured to interface with the fin 3100 to provide the interference seal when the valve stem 2004 is in the second limit position. In the example shown, the seat 3900 is provided on the exterior surface of the valve stem. However, it will be appreciated that in arrangements where the fin 3100 is on the valve stem, the seat 3900 can be provided on the interior of the housing. The seat 3900 preferably comprises a chamfered or tapered surface, in other words an angled surface, configured to abut and slide against the fin 3100. This provides a superior seal during actuation. Preferably, the fin 3100 extends into the path of the seat by at least 0.1 mm, preferably between 0.1 mm and 0.2 mm inclusive. This ensures that the fin 3100 and seat form a tight interference seal during actuation, without creating too much (or too little) friction, both of which could cause failure of the discharge assembly.

Preferably, the interference seal formed between the fin 3100 and the valve stem 2004 has a length of between 0.2 mm and 3 mm, preferably between 1 mm and 2 mm. The length of the interference seal can be considered to be the length, in the direction of actuation of the valve stem, where the fin 3100 abuts against the valve stem in the second limit position. In other words, the seal length can be considered to be the length of fin material which abuts against the valve stem to form the seal. The above-described seal lengths ensure a good seal without producing too much (or too little) friction, which could also cause failure of the discharge assembly.

The use of a fin 3100 provides a far more reliable seal than using an O-ring or resin bead. In particular, the temporary seal is formed along the length of the fin rather than only at a single point of contact as occurs between the O-ring/bead and housing in the prior art arrangement. This means that the seal is less prone to degrading by friction. Tolerances are more forgiving, as the fin need not be as precisely moulded as the O-ring or resin bead. Ovality is far less of a problem when moulding a fin than a resin bead/O-ring, and it is easier to extract the moulding pin when forming a fin due to its naturally angled shape. This means manufacture times can be decreased.

The present inventors have identified that the manufacture cycle time to produce the improved discharge assembly 4003 is reduced to around 8-10 seconds, as a result of the ability to use a thinner base portion 2009 and use of a fin 3100. This is compared to the 40 second cycle time to produce the original discharge assembly 2003, as discussed previously.

Additionally, and as noted above, by using a fin 3100 the seal between valve stem 2004 and housing can be made longer. This makes for a more reliable seal, as noted above, and also crucially allows for a longer stroke length than a sealing O-ring or bead. The stroke length represents the maximum distance which the valve stem 2004 can be depressed during actuation. A longer stroke length opens up greater possibilities in terms of use cases for the discharge assembly 4003. For example, the assembly can be used in an automated actuation device, such as an automated air freshener. Such automated devices typically require a minimum stroke length of 2 mm to work reliable. In particular, the present inventors have identified that a discharge assembly having a stroke length of less than 2 mm will not allow the automated lever or arm in an automated dispenser to extend by 2 mm. This may result in the automated dispenser thinking that it has not dispense the metered volume. The automated arm or level continuously tries to press down, as a result. This continues until the battery runs out, which can occur fairly quickly due to the continuous depression of the lever or arm. By contrast, use of a fin 3100 and the improved assembly 4003 as described above means it is possible to provide a discharge assembly having a stroke length of 2 mm or more, which avoids the above-described malfunction when utilising an automated dispenser. This is in contrast to the previous assembly 2003, where the stroke length was very limited for the reasons discussed above. The present inventors identified that a stroke length of 2 mm was generally not possible or practicable using the previous discharge assembly 2003, in contrast to the improved discharge assembly 4003.

Figure 7B:
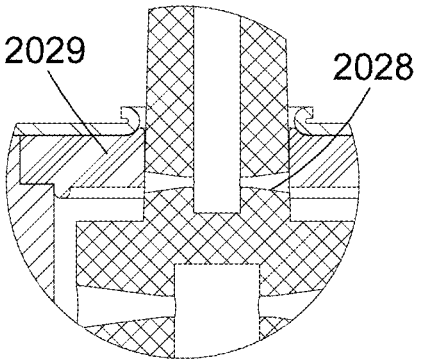
Figure 7C:
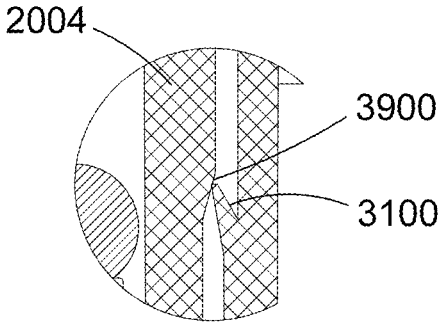

FIG. 7A shows the improved discharge assembly 4003 of FIGS. 6A-6C, but now in a semi-actuated position and from a 90 degree rotated angle. FIGS. 7B and 7C correspond to view D-D shown in FIG. 7A and show a close-up of the assembly. As can be seen, fin 3100 is configured to create the temporary seal just as or just before fluid pathways 2028 are opened to fluid flow by virtue of moving below seal 2029. This ensures correct functioning of the assembly 4003.

Figure 8B:
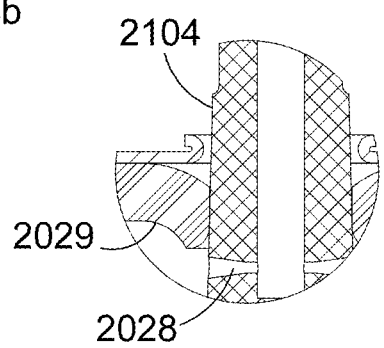
Figure 8C:
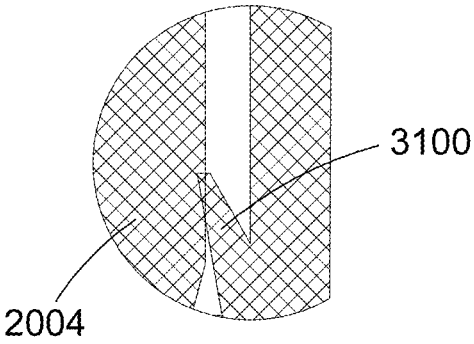

FIGS. 8A-8C show the same improved discharge assembly 4003 now at its fully actuated position, i.e. with the valve stem 2004 in its second limit position. As shown in FIG. 8C, the fin 3100 forms a long and secure sealing surface (the temporary seal mentioned above) against the valve stem. Fluid flow around the outside of valve stem 2004 (i.e. the path between volumes 2109, 2110 and 2111) is now completely sealed, and discharge element 2031 is thus forced upwards by fluid pressure to expel a metered dose, as described more fully above with reference to FIGS. 1A-2C.

As in the previous arrangement, the liquid discharge element 2031 abuts against a sealing surface 2034*s* when in the liquid discharged position, as shown in FIG. 8A. An improvement has been made to this arrangement, however, in that in the improved discharge assembly 4003 said sealing surface 2034*s* is chamfered. A chamfered sealing surface provides an improved sealing against discharge element 2031 and is easier to machine with more forgiving tolerances when compared to the sharp edge required by a 180 degree angle. In particular, small imperfections in a chamfered sealing surface are less likely to cause the seal to fail than similarly sized imperfections in a sharp edge surface.

FIGS. 9A-9E show various sealing surfaces 2034*s* that can be implemented in the valve assembly of the present disclosure.

Figure 9A:
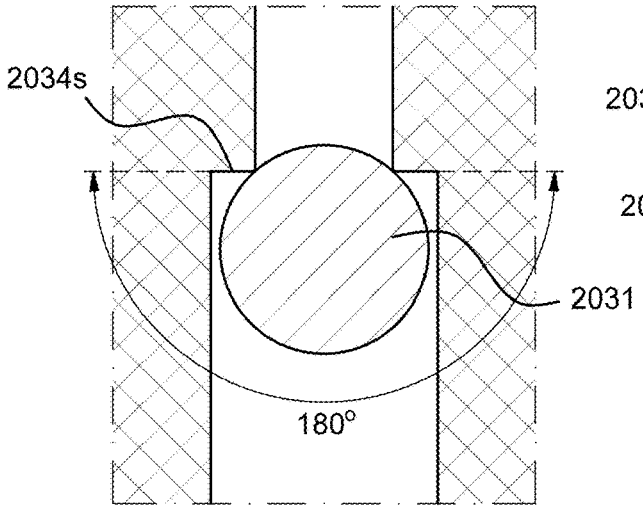
FIGS. 9A-9E show different arrangements of a sealing surface that can be used in the discharge assembly.

FIG. 9A shows the traditional, sharp-edged sealing surface used in the prior art. The sealing edges are sharp corners to produce a 180 degree sealing angle. As noted above, machining or moulding this sealing surface precisely enough to ensure a good seal has been found to be very challenging, resulting in unreliability of the seal.

FIGS. 9B-9E show alternative, improved sealing surfaces developed by the present inventors. Each of these sealing surfaces provides an improved seal with respect to the sealing surface of FIG. 9A.

Figure 9B:
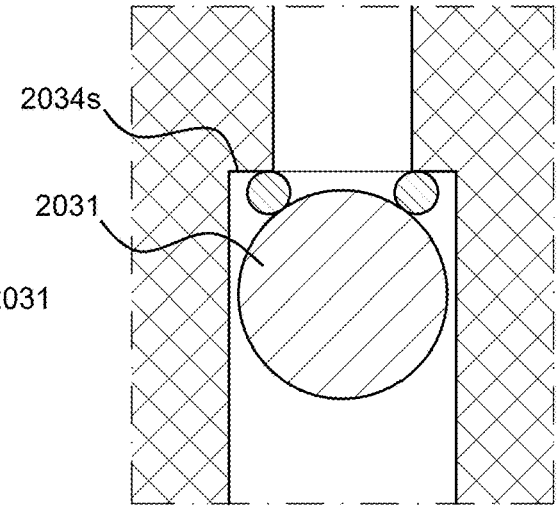

Turning first to FIG. 9B, one alternative sealing surface 2034*s* developed by the present inventors comprises a gasket or O-ring placed against the valve stem. The sealing surface thus incorporates the gasket or O-ring and it is this gasket or O-ring against which the liquid discharge element 2031 seals during actuation. The O-ring may be made of any suitable material, such as rubber. An O-ring or gasket seal has been found to provide a very reliable seal against the liquid discharge element 2031.

One drawback of using an O-ring or gasket is that it must be inserted into the valve stem during manufacture time. This is challenging, because the O-ring or gasket typically has a similar diameter to the valve stem interior, such that insertion of the O-ring or gasket is difficult and time consuming. This negatively impacts cycle time in manufacture of the valve assembly.

Figure 9C:
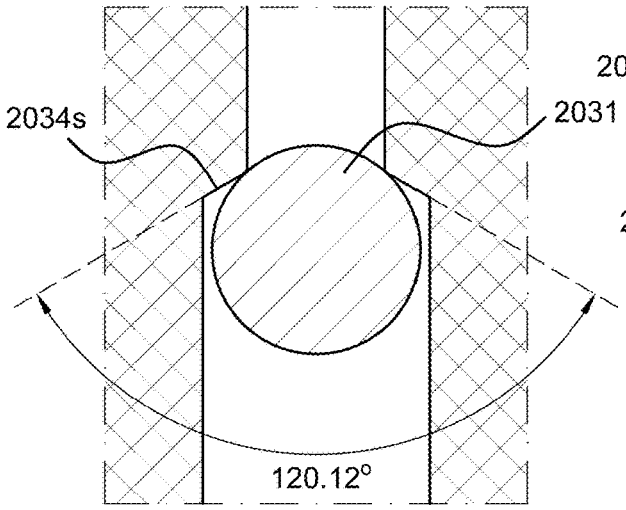
Figure 9D:
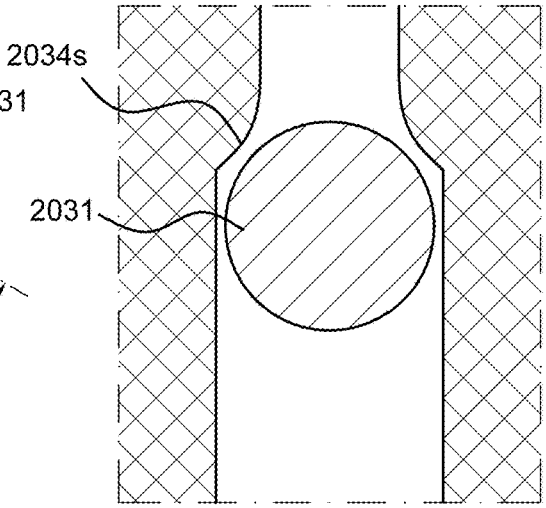
Figure 9E:
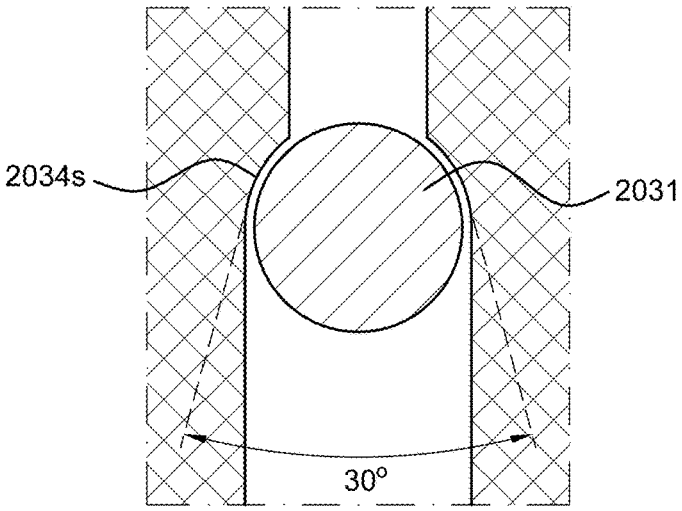

FIGS. 9C-9E show alternative sealing surfaces 2034*s* developed by the present inventors that do not require an O-ring or gasket, though they can be combined with an O-ring or gasket if desired.

The sealing surface of FIG. 9C comprises a chamfered sealing surface 2034*s*, as shown previously in FIGS. 6-8. Preferably, the chamfer is at an angle between 120 and 180 degrees relative to the longitudinal axis of the valve stem. More preferably the angle is between 120 and 160 degrees, as shown in FIG. 9C which uses a 120.12 degree angle. Chamfer angles in these ranges provide a particularly good seal against discharge element 2031 and are easy to manufacture.

Another alternative sealing surface 2034*s* is shown in FIG. 9D. This sealing surface 2034*s* comprises a convex curved profile. This causes the sealing surface to protrude into the path of the liquid discharge element. The present inventors have determined that such a convex sealing surface 2034*s* is less prone to ovality effects than the chamfered flat surface of FIG. 9C. In particular, ovality effects, such as caused by warping during cooling or manufacture of the valve stem, are less likely to cause a leak at the convex sealing surface of FIG. 9D than in the flat chamfered surface of FIG. 9C. Put another way, tolerances in the curved surface are less severe than for a chamfered surface.

Preferably, where the sealing surface has a curved convex profile, its radius is from 1.5 mm to 1.8 mm as measured from the centre point of its curvature at the point of maximal curvature. In other words, a circle overlapping with the most curved portion of the convex surface would have a radius in this range. The present inventors have identified that this range of radii provide a particularly good seal against liquid discharge element 2031.

Another alternative sealing surface 2034*s* is shown in FIG. 9E. This sealing surface 2034*s* comprises a concave curved profile, also referred to as a "dish" shaped profile. The concave volume defined by this surface 2034*s* is able to receive the liquid discharge element 2031, thereby providing a good seal. The concave surface provides many of the same benefits as the convex surface, described above. In particular, such as sealing surface can also be manufactured with less stringent tolerances than a flat chamfered surface whilst still providing a good seal.

Preferably, where the sealing surface 2304*s* has a concave curved profile, the lowermost surfaces of the sealing surface (i.e. the point of connection between the sealing surfaces and the vertical valve stem walls) define an angle between 20 degrees and 40 degrees relative to the longitudinal axis of the valve stem, into which the liquid discharge element is received. More preferably, the angle is between 25 and 35 degrees, more preferably the angle is approximately 30 degrees, as shown in the example of FIG. 9E. The present inventors have identified that this range of angles provide a particularly good seal for a concave sealing surface.

Preferably, one or more internal volumes of the discharge assembly are tapered. This may include the interior volume of the valve stem 2004, one or more housing portions 2007*a,b*, any spigots and any fluid passageways in the assembly 4003. In the example shown, the internal volume of the top housing portion 2007*a*, the internal volume of inlet 2011 in the bottom housing portion 2007*b*, and fluid transfer passageways 2026 and 2028 are all tapered. This tapering enables easier removal of the moulding pin during manufacture. A taper angle, which may also be referred to as a draft angle, of between 0.5 and 3 degrees is particularly effective at allowing moulding pin removal. Preferably, the taper (or draft) angle is 1 degree.

Providing one or more tapered fluid flow transfer passageways 2026 in valve stem 2004 is particularly advantageous. Not only does this shape facilitate easier moulding (as just discussed), but also provides superior fluid flow and actuation dynamics. This is because each end of the tapered passageway 2026 has a different diameter. For example, when passing into the top of metering chamber 2034*a/b* of the valve 2004, fluid enters the passageway 2026 via a relatively larger (wider) diameter port and exits the passageway 2026 via a relatively smaller (thinner) diameter port. This change of diameter results in an increase in velocity of the fluid, by virtue of the Venturi effect. This change of velocity is also accompanied by a decrease in static pressure in the metering chamber and an increase in flow rate. As a result of these changes in the fluid dynamics within the assembly, the valve chamber 2034*a/b* refills faster and discharge element 2031 is forced into its rest (or primed) position more quickly following actuation. This allows for more rapid repeated actuation of the valve assembly. In an example, the diameter of the wider end of the fluid passageway(s) 2026 is between 0.9 and 1.2 mm while the diameter of the smaller end of the fluid passageway(s) 2026 is between 0.4 and 0.6 mm. These dimensions result in particularly good fluid flow dynamics and fast reset/refill following actuation.

Similar advantages are gained by providing one or more tapered second fluid transfer passageways 2028 in the head portion 2104 of the valve stem 2004. This ensures that fluid accelerates as it enters outlet conduit 2025, resulting in rapid emptying of the valve and good atomisation of the fluid flow. In an example, the diameter of the wider end of the second fluid passageway(s) 2028 is between 0.2 and 0.7 mm while the diameter of the smaller end of the second fluid passageway(s) 2028 is between 0.1 and 0.3 mm. These dimensions result in particularly good fluid flow dynamics and fast actuation potential.

Advantageously, the present assembly 4003 enables the metered dose discharged by the discharge assembly to be accurately determined and modified simply by modifying the length of upstanding tubular spigot 2102. This spigot 2102 encircles the housing liquid inlet 2011 and projects upwardly into the interior of the housing, thereby defining how much volume is left for fluid. By changing the dimensions of the upstanding spigot 2102 (e.g. at moulding time), the discharge assembly can be configured to discharge a specific metered volume, where preferably the volume is between 30 microliters and 150 microliters. The height of the spigot can be modified easily and without requiring further modification to the exterior housing. This makes it easier to manufacture the discharge assembly to be suited for different tasks.

Figure 10:
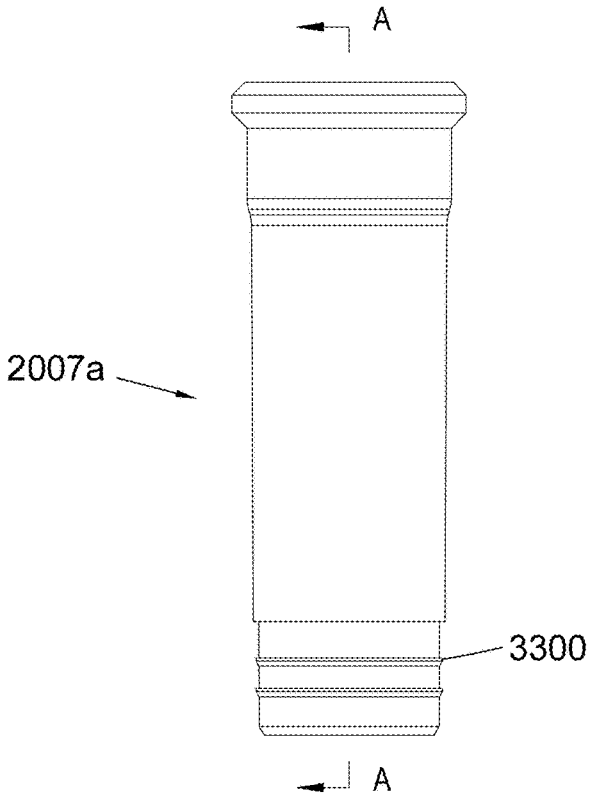
FIGS. 10-12 show an example top housing portion for use in the improved discharge assembly.
Figure 11:
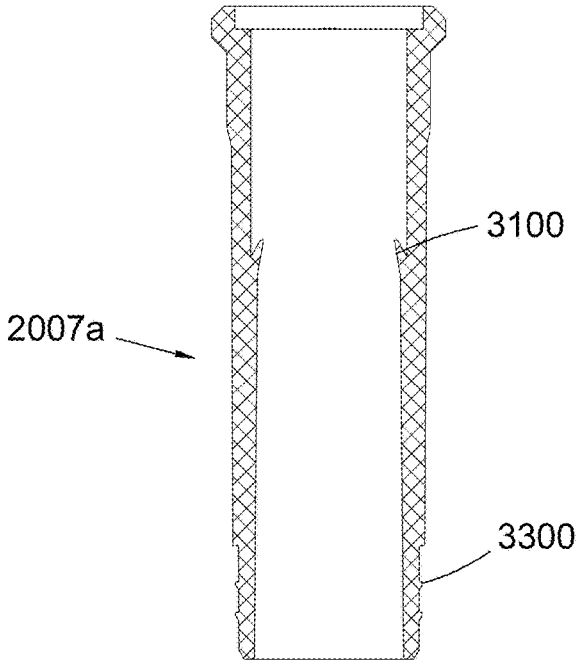
Figure 12:
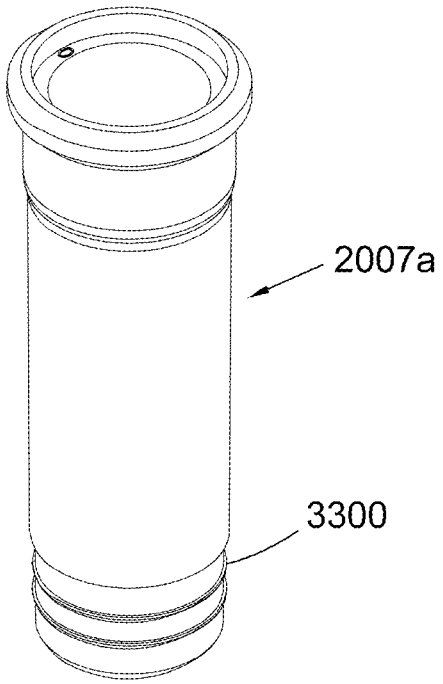

To facilitate understanding of the improved discharge assembly 4003, FIGS. 10-12 show in greater detail an example arrangement of the upper housing portion 2007*a*. FIG. 10 shows a side on view of the upper housing portion 2007*a*. FIG. 11 shows a cross section view corresponding to view A-A shown in FIG. 10. The fin 3100 is clearly visible, as are the protuberances 3300 for creating an interference fit with bottom housing portion 2007*b* are. FIG. 12 shows a perspective view.

Figure 13:
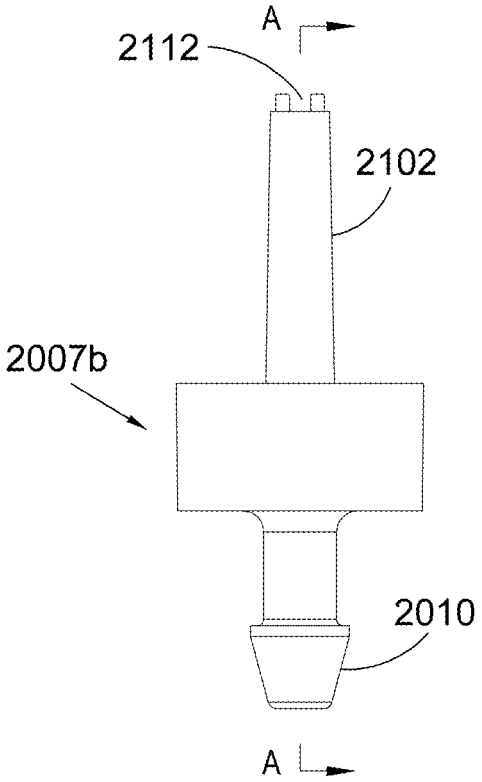
FIGS. 13-15 show an example bottom housing portion for use in the improved discharge assembly.
Figure 14:
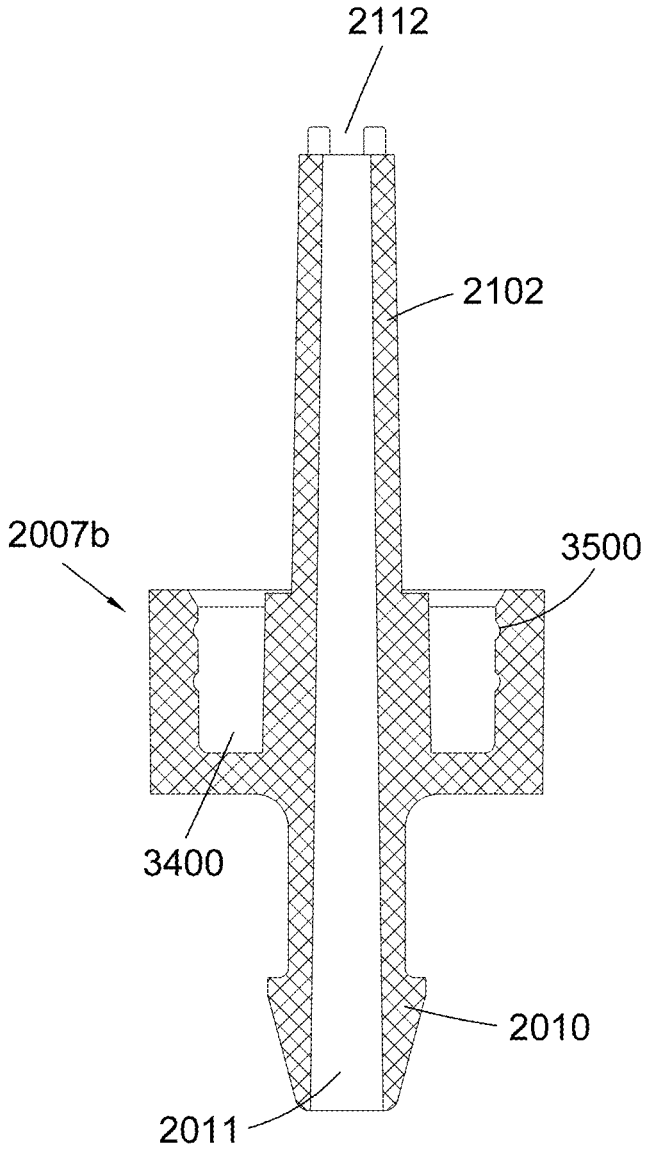
Figure 15:
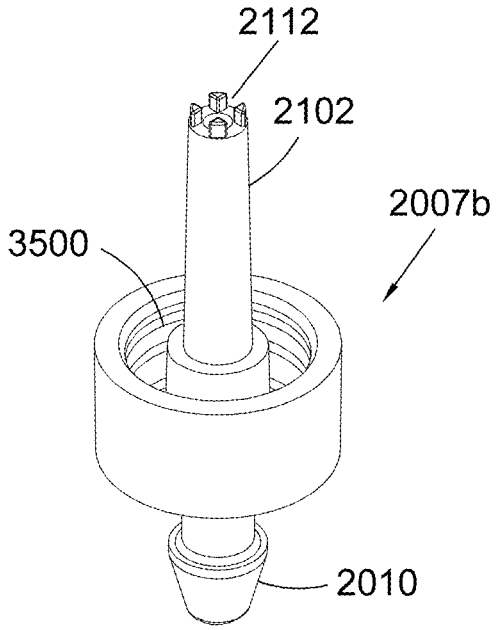

Similarly, an example arrangement of the lower housing portion 2007*b* is shown in FIGS. 13-15. FIG. 13 shows a side on view of the lower housing portion 2007*b*. FIG. 14 shows a cross section view corresponding to view A-A shown in FIG. 13. A channel 3400 and recesses 3500 for creating an interference fit with top housing portion 2007*a* are clearly visible. FIG. 15 shows a perspective view.

Refill of the improved assembly 4003 can be performed in any of the manners described above with respect to FIGS. 1A-2C. In particular, valve stem 2004 may be depressed, and refill fluid may then flow down outlet 2025, out of second fluid flow passageways 2028, into fluid flow passageways 2026, around discharge element 2031, into spigot 2102 via slots 2112 and out of inlet 2011 into the container to which the assembly 4003 is attached. Alternatively, single-use devices may be provided. In this case, the valve assembly 4003 is dropped into place on a pre-pressurised container and is then crimped (or clinched) into place with a mounting cup 3200. In the single-use case, no refill mechanism needs to be provided.

The apparatus of the present invention may be used as an aerosol spraying device. Such a device may be used to deliver various materials, preferably materials dissolved or dispersed in water. For example, the liquid in the container may contain a range of materials selected from the group consisting of pharmaceutical, agrochemical, fragrance, air freshener, odour neutraliser, sanitizing agent, depilatory chemical (such as calcium thioglycolate), epilatory chemical, cosmetic agent, deodorant, anti-perspirant, anti-bacterial agents, anti-allergenic compounds, and mixtures of two or more thereof. Furthermore, the container may contain a foamable composition, optionally containing any of the materials disclosed immediately hereinbefore. The water in the container may optionally contain one or more organic solvents or dispersants in order to aid dissolution or dispersion of the materials in the water.

The apparatus of the present invention may be used with an apparatus having a dispensing mechanism which turns on and off periodically. This may be automated.

For example, the apparatus of the present invention may be used to provide an air treatment agent to an air treatment device comprising: an airborne agent detector comprising one or more airborne agent sensors, wherein the airborne agent detector comprises means to detect a threshold level or concentration of an airborne agent; a means to mount the apparatus of the present invention (including the pressurised container where present) to the device; and a means to expel a portion of air treatment agent from the apparatus of the present invention, upon detection of an airborne agent by the detector. Such an air treatment device (not including the apparatus of the present invention) is disclosed in WO 2005/018690 for example. Alternatively, the apparatus of the present invention may be used to dispense a composition from a spraying device as disclosed in WO 2007/045826.

The material used to form liquid discharge element 2031 may be any suitable material. Preferably, the liquid discharge element comprises or is comprised of a thermoplastic elastomer, more preferably a vulcanised thermoplastic elastomer. A suitable example material is Santoprene®. The inventors have identified that these materials produce particularly good sealing between the liquid discharge element and the sealing surface in the valve stem. Steel is also a suitable material and is typically cheaper than thermoplastic elastomer.

Preferably the liquid discharge element has a shore hardness of 40 to 70 as measured on the Shore D hardness scale. This again has been determined to provide a robust liquid discharge element that is hard enough for long term use without degrading, whilst still being soft enough to seal correctly and with a good fit against the sealing surface of the valve stem.

Preferably, the weight of the liquid discharge element is at least 0.03 g so as to ensure that the liquid discharge element reliably sinks under the action of gravity after it has discharged a metered volume. The liquid discharge element may comprise more than one material, for example a first portion of a first material combined or connected to a second portion of a second material. In one advantageous embodiment, a first portion of the liquid discharge element is formed of a thermoplastic elastomer, so as to provide a good seal against the sealing surface of the valve stem, and a second portion of the liquid discharge element is formed of a heavier material, such as steel, so as to provide sufficient weight to cause the liquid discharge element to sink under gravity after actuation. The first and second portions may be integral and/or form first and second ends of the liquid discharge portion.

The invention claimed is:

1. A discharge assembly for discharging a metered volume of a liquid held in a pressurised or pressurisable container, said assembly comprising:

(i) a housing having a liquid inlet at a first end thereof, (ii) a valve stem having a body locating within said housing and having a head portion projecting from the second end of said housing, said valve stem being axially moveable relative to the housing between a first limit position at which the assembly is closed to liquid discharge and a second limit position for discharge of the metered volume, (iii) a chamber provided within the body of the valve stem and having a liquid inlet towards a first end of the chamber and a first fluid transfer passageway towards the opposite, second end of the chamber, said first fluid transfer passageway providing communication between the chamber and the exterior of the valve stem, and (iv) a liquid discharge element moveable along said chamber from a liquid primed position to a liquid discharged position to effect discharge of the metered volume of liquid, (v) a fin configured to create a temporary interference seal between the interior of the housing and the exterior of the valve stem, the fin extending at an upward angle, wherein the exterior of the valve stem and the interior of the housing are configured such that:

(a) in the first limit position of the valve stem there is a second fluid transfer passageway along the outside of the valve stem between the inlet of the housing and said first fluid transfer passageway, and (b) in the second limit position of the valve stem the fin creates a temporary interference seal between the interior of the housing and the exterior of the valve stem so as to close said second fluid transfer passageway to fluid flow.

2. The discharge assembly of claim 1, wherein the fin is provided on the interior of the housing.

3. The discharge assembly of claim 2, wherein the fin is integral with the interior of the housing.

4. The discharge assembly of claim 1, further comprising a seat configured to interface with the fin to provide the interference seal when the valve stem is in the second limit position.

5. The discharge assembly of claim 4, wherein the seat comprises a chamfered surface.

6. The discharge assembly of claim 4, wherein the fin extends into the path of the seat by at least 0.1 mm.

7. The discharge assembly of claim 1, wherein the temporary interference seal has a length of between 1 mm and 2 mm.

8. The discharge assembly of claim 1, wherein the housing comprises a top housing portion and a bottom housing portion.

9. The discharge assembly of claim 8, wherein the top housing portion and the bottom housing portion are joined by a permanent interference fit.

10. The discharge assembly of claim 8, wherein the bottom housing portion comprises a channel configured to receive the top housing portion.

11. The discharge assembly of claim 10, wherein the channel further comprises recesses configured to receive corresponding protuberances on the top housing portion or wherein the channel further comprises protuberances configured to interface with corresponding recesses on the top housing portion.

12. The discharge assembly of claim 8, wherein at least one of the following volumes is tapered:

the chamber provided within the body of the valve stem;

an internal volume of the top housing portion;

an internal volume of the bottom housing portion; or the first fluid transfer passageway.

13. The discharge assembly of claim 8, wherein the bottom housing portion comprises an upstanding tubular spigot which encircles the inlet and projects upwardly into the interior of the housing.

14. The discharge assembly of claim 1, wherein the discharge assembly has a stroke length of at least 2 mm.

15. The discharge assembly of claim 1, wherein the liquid discharge element abuts a sealing surface when in a liquid discharged position, said sealing surface is provided within the valve stem chamber.

16. The discharge assembly of claim 15, wherein the liquid discharge element is negatively buoyant in the liquid to be dispensed so as to provide at least a part of said returning force.

17. The discharge assembly of claim 1, wherein the liquid discharge element is moveable by a returning force from its liquid discharged position to its liquid primed position.

18. The discharge assembly of claim 1, wherein the head portion of the valve stem projecting from the second end of the housing is moveable within an annular seal provided at the second end of the housing and said head portion has a third fluid transfer passageway communicating with an outlet of the head portion, said third transfer passageway being sealed to fluid flow in the first limit position of the valve stem and open to fluid flow in the second limit position thereof.

19. The discharge assembly of claim 1, wherein the inlet to the housing is coaxial with the valve stem chamber.

20. The discharge assembly of claim 1, wherein the fin has a length of between 0.2 mm and 3 mm.

21. The discharge assembly of claim 1, wherein the fin is a single fin and the temporary interference seal between the interior of the housing and the exterior of the valve stem is created by the single fin.

22. A liquid dispensing apparatus, the liquid dispensing apparatus comprising a discharge assembly for discharging a metered volume of a liquid held in a pressurised or pressurisable container of the liquid dispensing apparatus, the discharge assembly comprising:

(i) a housing having a liquid inlet at a first end thereof, (ii) a valve stem having a body locating within said housing and having a head portion projecting from the second end of said housing, said valve stem being axially moveable relative to the housing between a first limit position at which the assembly is closed to liquid discharge and a second limit position for discharge of the metered volume, (iii) a chamber provided within the body of the valve stem and having a liquid inlet towards a first end of the chamber and a first fluid transfer passageway towards the opposite, second end of the chamber, said first fluid transfer passageway providing communication between the chamber and the exterior of the valve stem, and (iv) a liquid discharge element moveable along said chamber from a liquid primed position to a liquid discharged position to effect discharge of the metered volume of liquid, (v) a fin configured to create a temporary interference seal between the interior of the housing and the exterior of the valve stem, the fin extending at an upward angle, wherein the exterior of the valve stem and the interior of the housing are configured such that:

(a) in the first limit position of the valve stem there is a second fluid transfer passageway along the outside of the valve stem between the inlet of the housing and said first fluid transfer passageway, and (b) in the second limit position of the valve stem a fin creates a temporary interference seal between the interior of the housing and the exterior of the valve stem so as to close said second fluid transfer passageway to fluid flow.

23. A liquid dispensing apparatus as claimed in claim 22, wherein:

the container is pressurised with nitrogen, air, liquefied natural gas, liquefied hydrocarbon gas or carbon dioxide; or the apparatus is an aerosol spraying device; or the apparatus contains a compound or composition comprising material selected from the group consisting of pharmaceutical, agrochemical, fragrance, air freshener, odour neutraliser, sanitizing agent, polish, insecticide, depilatory chemical (such as calcium thioglycolate), epilatory chemical, cosmetic agent, deodorant, anti-perspirant, anti-bacterial agents, anti-allergenic compounds, and mixtures of two or more thereof.

24. The discharge assembly of claim 22, wherein the fin has a length of between 0.2 mm and 3 mm.

25. The discharge assembly of claim 22, wherein the fin is a single fin and the temporary interference seal between the interior of the housing and the exterior of the valve stem is created by the single fin.

* * * * *